US010093027B2

(12) United States Patent
Garavaglia et al.

(10) Patent No.: US 10,093,027 B2
(45) Date of Patent: Oct. 9, 2018

(54) SAFETY CUTTER

(71) Applicant: Pacific Handy Cutter, Inc., Irvine, CA (US)

(72) Inventors: Joseph P. Garavaglia, Newport Beach, CA (US); Brandon L. Spoelstra, Huntington Beach, CA (US); Markus Gropl, Huntington Beach, CA (US); Chris Lung, Santa Ana, CA (US)

(73) Assignee: PACIFIC HANDY CUTTER, INC., Irvine, CA (US)

( * ) Notice: Subject to any disclaimer, the term of this patent is extended or adjusted under 35 U.S.C. 154(b) by 253 days.

(21) Appl. No.: 14/608,171

(22) Filed: Jan. 28, 2015

(65) Prior Publication Data

US 2016/0214264 A1 Jul. 28, 2016

(51) Int. Cl.
*B26B 5/00* (2006.01)
*B26B 29/02* (2006.01)

(52) U.S. Cl.
CPC ..... *B26B 5/001* (2013.01); *B26B 5/003* (2013.01); *B26B 29/02* (2013.01)

(58) Field of Classification Search
CPC ..... B26B 5/001; B26B 5/003; B26B 29/02; B26B 1/10; B26B 5/005
USPC ..... 30/162, 122, 164, 125, 335, 337–339, 30/158, 123, 161, 340
See application file for complete search history.

(56) References Cited

U.S. PATENT DOCUMENTS 7,024,772 B1 4/2006 Shaver et al.
7,082,688 B2 8/2006 Votolato
7,100,285 B1 * 9/2006 Huang ..... B26B 5/001 30/125
D575,613 S 8/2008 Jennings
7,784,189 B2 8/2010 Polei
8,056,241 B2 11/2011 Davis et al.
8,069,571 B2 12/2011 Chung et al.
8,127,452 B2 3/2012 Garavaglia et al.
8,250,764 B2 8/2012 Davis et al.
8,572,852 B1 * 11/2013 Jennings ..... B26B 5/001 30/162
8,904,649 B2 * 12/2014 Garavaglia ..... B26B 5/001 30/125
9,205,568 B2 12/2015 Garavaglia et al.
9,205,569 B2 12/2015 Garavaglia et al.
(Continued)

*Primary Examiner* — Ghassem Alie
(74) *Attorney, Agent, or Firm* — Peter L. Holmes

(57) ABSTRACT

A cutter apparatus includes a housing shaped to be hand-held, the housing including first and second handle portions shaped and/or adapted to interfit together, a blade holder configured to support a blade, and a lock/unlock mechanism for securing the handle portions together, the lock/unlock mechanism including multiple actuators operable for extending the blade from the housing, the actuators including a primary actuator coupled to the blade holder and repositionable in relation to the housing, and at least one auxiliary actuator including a first auxiliary actuator supported by and repositionable in relation to the first handle portion. The primary and auxiliary actuators are biased toward and/or repositionable to respective locations at which an aperture of the first auxiliary actuator coaligns or registers with an opening in the first handle portion in an unlock configuration that allows a user of the cutter apparatus to reposition/separate the handle portions from each other.

12 Claims, 19 Drawing Sheets

(56) References Cited

U.S. PATENT DOCUMENTS

| | | | | |
|---|---|---|---|---|
| 9,676,106 | B2 | 6/2017 | Garavaglia et al. | |
| 2005/0193566 | A1* | 9/2005 | Brown | B26B 5/001 30/162 |
| 2010/0037466 | A1* | 2/2010 | Rowlay | B26B 5/001 30/153 |
| 2013/0061475 | A1 | 3/2013 | Lutgen et al. | |
| 2013/0061479 | A1 | 3/2013 | Lutgen et al. | |
| 2013/0305539 | A1* | 11/2013 | Garavaglia | B26B 1/10 30/122 |
| 2014/0259686 | A1 | 9/2014 | Garavaglia et al. | |

* cited by examiner

FIG. 14A
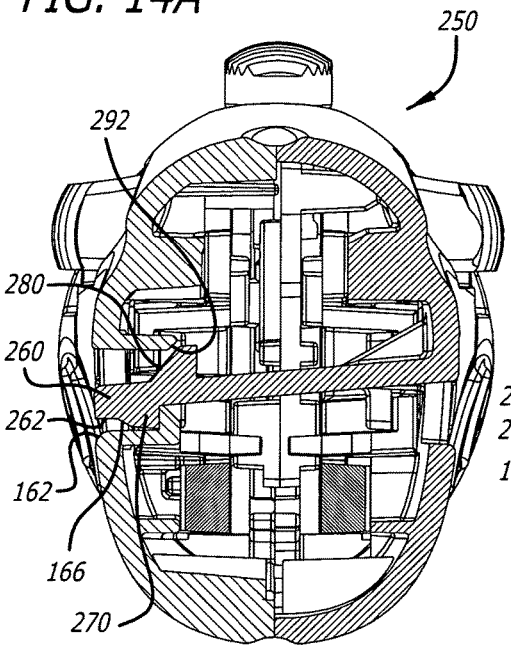
FIG. 14B
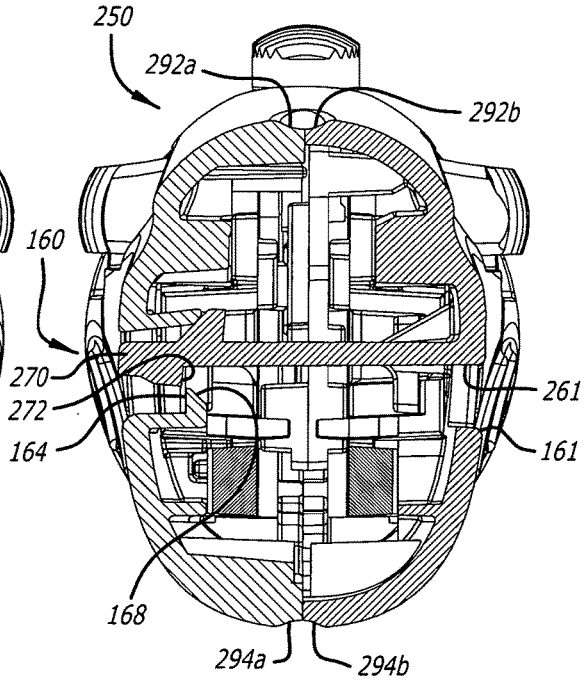
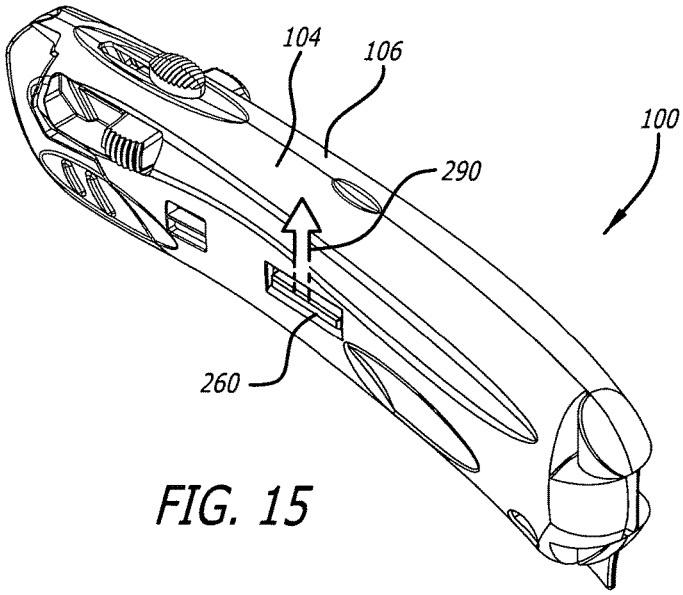
FIG. 15

FIG. 21
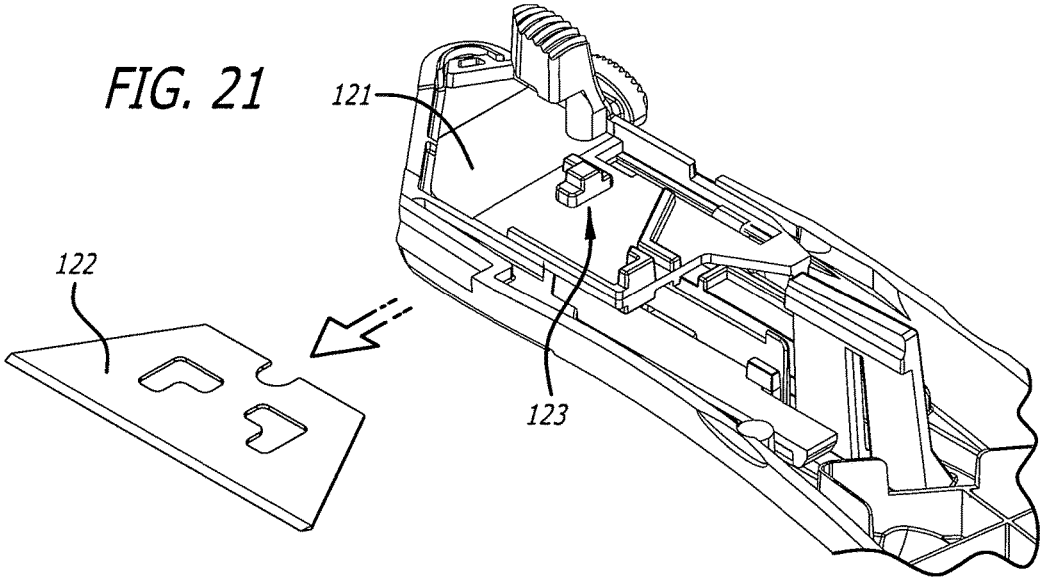
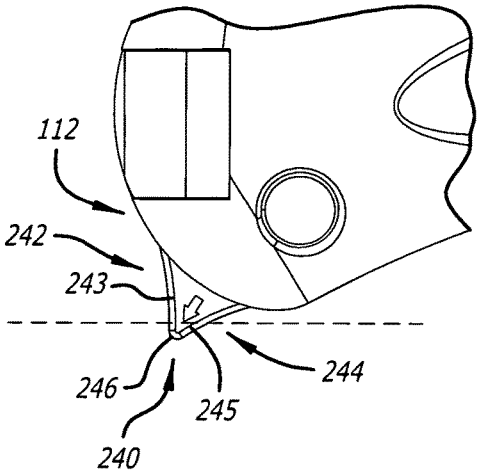
FIG. 22A
FIG. 22B
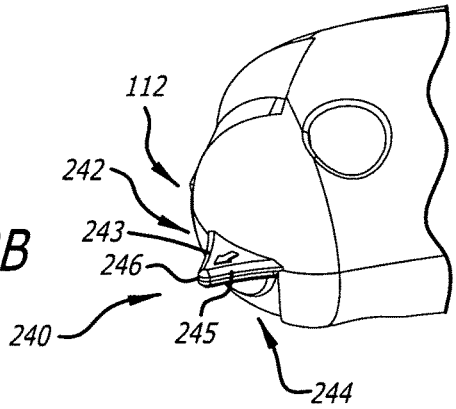

SAFETY CUTTER

CROSS-REFERENCE TO RELATED APPLICATIONS

This application is related to U.S. Design patent application No. 29/516,022, entitled "Cutter Apparatus Body" filed herewith (now U.S. Pat. No. D779,301, issued on Feb. 21, 2017), which is hereby incorporated by reference.

TECHNICAL FIELD

The present invention relates generally to cutters and, in particular, a cutter or cutter apparatus with multiple cut guides (or guards) and/or actuators variously facilitating blade deployment and other cutter features and functionalities.

BACKGROUND ART

A great variety of knives, cutters, safety cutters, and cutter apparatuses are known. Features variously found in prior knives, cutters, safety cutters, and cutter apparatuses include mechanisms and devices facilitating, for example, blade deployment, blade change, or blade storage.

It is known to provide a safety cutter with a guard (or guide) located a short distance from and facing a side of the cutting blade. See e.g., U.S. Pat. No. 5,386,632, U.S. Pat. No. 6,314,646 B1, U.S. Pat. No. D544,774 S, and U.S. Pat. No. 7,987,602 B2, which are hereby incorporated by reference.

It would be useful to be able to provide a cutter or cutter apparatus with a mechanism or device that facilitates one or more of improved, advantageous, or otherwise desirable or useful cutter qualities and/or performance and/or providing of synergistic structural features relating to same.

SUMMARY OF THE INVENTION

In an example embodiment, a cutter apparatus includes a housing shaped to be hand-held, a blade carrier repositionable in relation to the housing and configured to support a blade thereon, and multiple cut guides independently operable to drive the blade carrier for extending the blade from the housing.

In an example embodiment, a cutter apparatus includes a housing shaped to be hand-held, the housing including handle portions shaped and/or adapted to interfit together, the handle portions providing a handle base, and cut guides coupled to the handle portions, respectively, and independently operable for extending a blade from the housing, the handle portions each being structurally rigid and/or nonfoldable from the handle base to openings of the handle portions from which the cut guides extend, respectively.

In an example embodiment, a cutter apparatus includes a housing shaped to be hand-held, the housing including left side and right side handle portions, a blade holder configured to support a blade, and multiple actuators independently operable for extending the blade from the housing, the actuators including a primary actuator coupled to the blade holder and repositionable along the housing, and a pair of auxiliary actuators supported by and repositionable in relation to the left side and right side handle portions, respectively, the primary actuator including a plurality of engagement portions including dual engagement portions which extend from openings in the left side and right side handle portions, respectively.

In an example embodiment, a cutter apparatus includes a housing shaped to be hand-held, the housing including first and second handle portions shaped and/or adapted to interfit together, a blade holder configured to support a blade, and a lock/unlock mechanism for securing the handle portions together, the lock/unlock mechanism including multiple actuators operable for extending the blade from the housing, the actuators including a primary actuator coupled to the blade holder and repositionable in relation to the housing, and at least one auxiliary actuator including a first auxiliary actuator supported by and repositionable in relation to the first handle portion, the primary and auxiliary actuators being biased toward and/or repositionable to respective locations at which an aperture of the first auxiliary actuator coaligns or registers with an opening in the first handle portion in an unlock configuration that allows a user of the cutter apparatus to reposition the first handle portion away from the second handle portion.

In an example embodiment, a cutter apparatus includes a housing with a handle portion, the housing being configured to allow a user of the cutter apparatus to deploy a blade, and a tape splitter formed or otherwise provided on the handle portion, the tape splitter having portions including chamfer surfaces.

In an example embodiment, a cutter apparatus includes a housing with a blade carrier configured for holding a blade, the housing including handle portions which are repositionable in relation to each other to and from a closed configuration, the housing including or being configured with a release/engagement mechanism for disengaging/securing together the handle portions, the release/engagement mechanism, when the handle portions are in the closed configuration, being accessible via an opening in a side portion of the housing.

In an example embodiment, a cutter apparatus includes a housing with housing portions which are coupled together and repositionable in relation to each other, and a blade holder and/or actuator coupled to one of the housing portions, the housing being configured with structures for guiding the housing portions when the housing portions are being brought together to a closed configuration, the structures including guide surface(s) or portion(s) of the blade holder and/or actuator and complementary surface(s) or portion(s) of another of the housing portions.

In an example embodiment, a cutter apparatus includes a housing shaped to be hand-held, a blade holder configured to support a blade, and one or more cut guides each having a blade-facing surface or portion including or defining a pattern of openings that reduce friction when cutting.

BRIEF DESCRIPTION OF THE DRAWINGS

FIG. 14A is a cross-sectional view of the cutter apparatus along lines 14A-14A of FIG. 1 showing a release/engagement mechanism (interface) in a latched or engaged configuration at which the housing (or handle) portions are secured together;

FIG. 14B is a cross-sectional view showing a release/engagement mechanism (interface) of FIG. 14A in a released or unlatched configuration at which the housing (or handle) portions can be repositioned away from each other;

FIG. 15 is a perspective view a release member of the release/engagement mechanism (interface) of FIGS. 14A and 14B, the release member being repositioned transitioning the mechanism (interface) to its released or unlatched configuration;

FIGS. 19-21 are partial perspective views showing the right side handle portion of the cutter apparatus of FIG. 1 and the blade holder (or blade carrier/actuator) of FIGS. 6A-6G at different steps of a blade change operation;

FIGS. 22A and 22B are partial right side and perspective views, respectively, of a handle base of the cutter apparatus of FIG. 1 showing a tape splitter with chamfer surfaces provided at the handle base;

DISCLOSURE OF INVENTION

Figure 1:
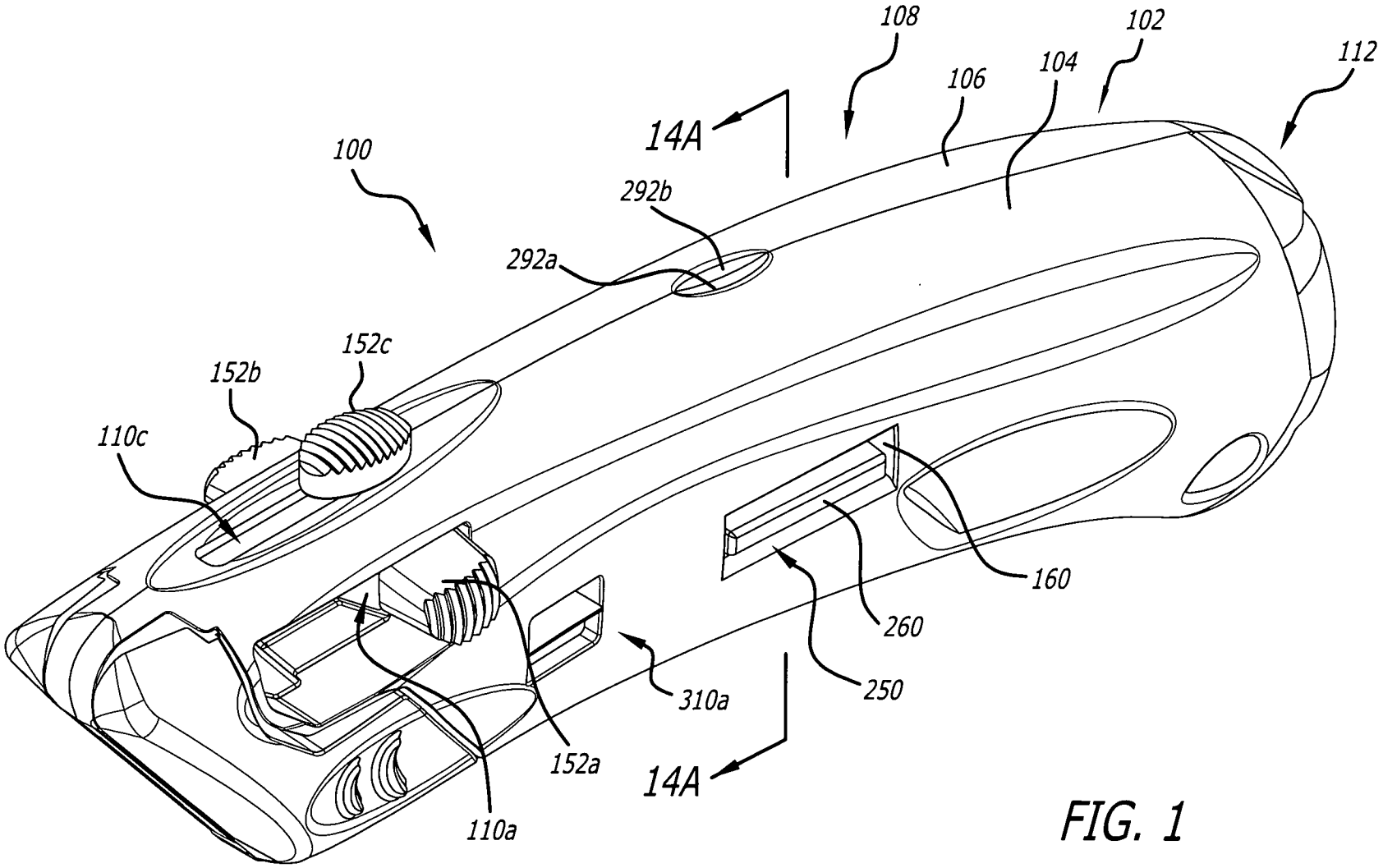
FIG. 1 is a perspective view of an example embodiment of a cutter apparatus.
Figure 2:
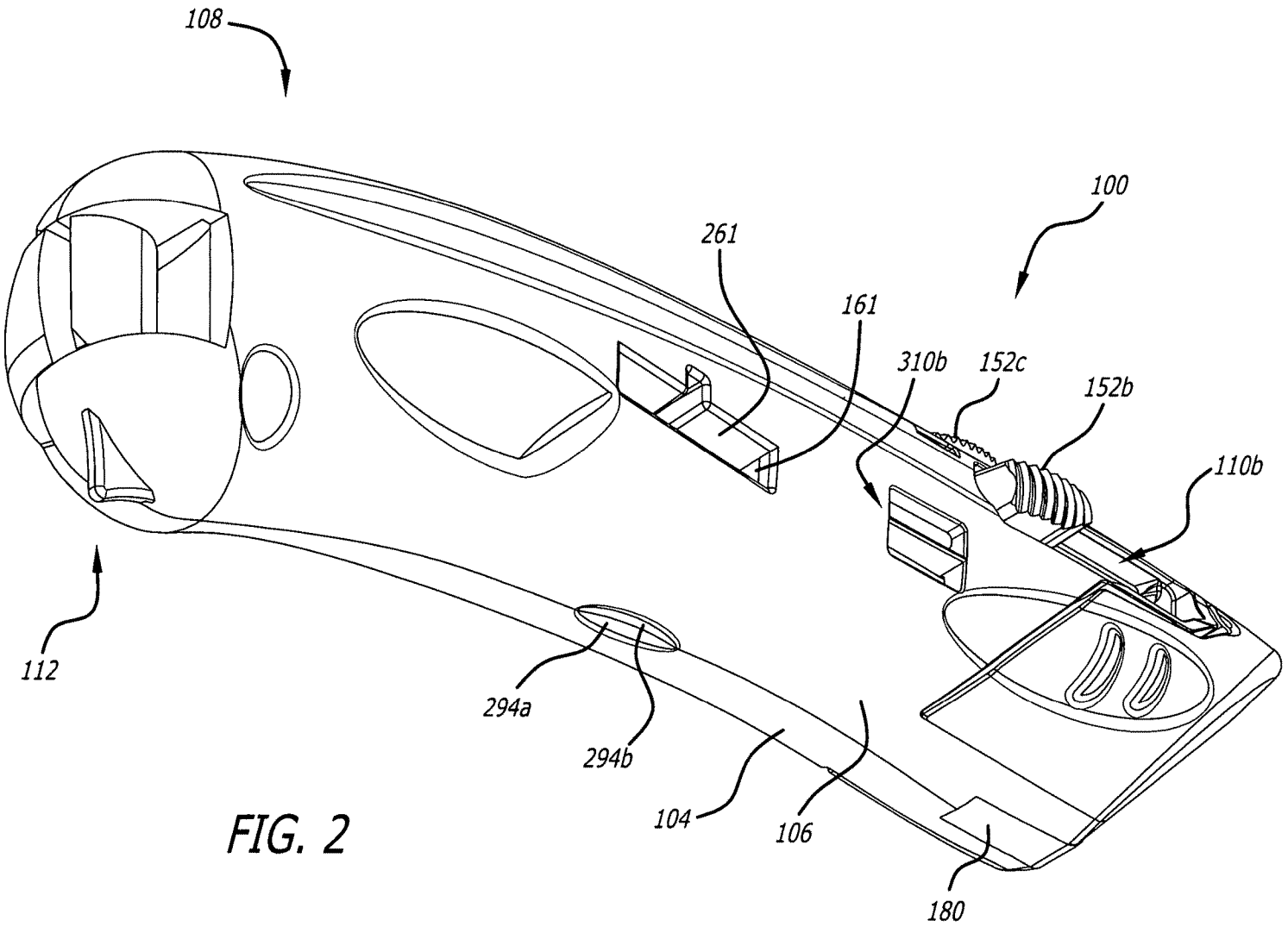
FIG. 2 is another perspective view of the cutter apparatus of FIG. 1.
Figure 3:
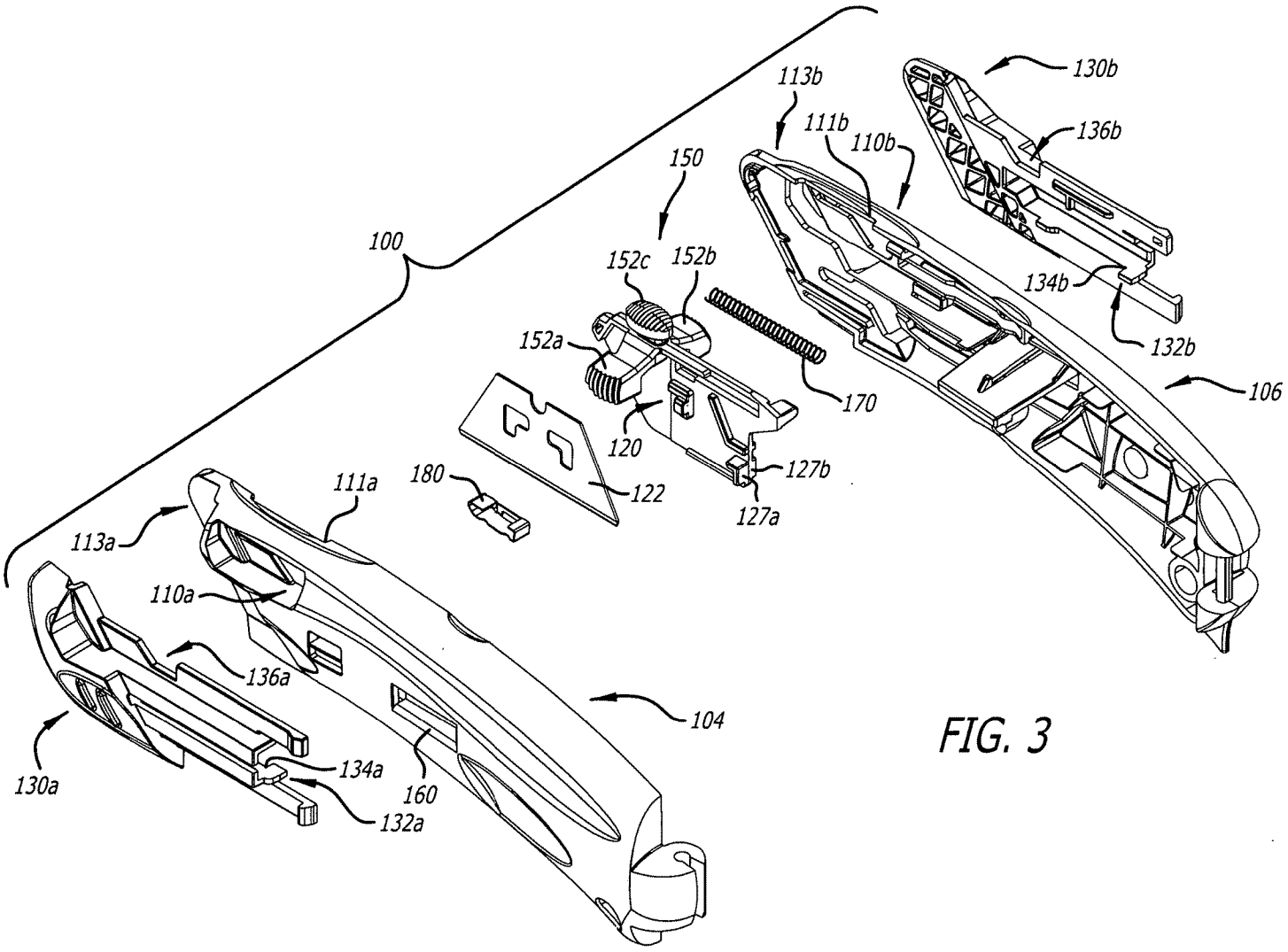
FIG. 3 is an exploded perspective view of the cutter apparatus of FIG. 1.

Referring to FIGS. 1-3, in an example embodiment, a cutter apparatus 100 includes a housing 102 (e.g., shaped to be hand-held as shown) having left side and right side handle portions 104, 106 (which together provide a handle 108). The left side and right side handle portions 104, 106 can be formed of various materials, for example, a thermoplastic that has high strength, rigidity, and impact resistance (e.g., Acrylonitrile butadiene styrene (ABS)), and by various processes (e.g., injection molding).

The cutter apparatus 100 includes a blade holder (or blade carrier) 120 repositionable in relation to the housing and configured to support a blade 122 thereon. Referring additionally to FIGS. 6A-6G, the blade carrier 120 includes a blade interface 123 (e.g., a raised, tiered structure configured as shown that fits into a blade opening) and rails 129 providing perimeter boundaries also preventing the blade 122 from sliding across surface 121. The blade holder (or blade carrier/actuator) 120 can be formed of various materials, for example, a thermoplastic that has high stiffness, dimensional stability, and low friction (e.g., Polyoxymethylene (POM) also known as Acetal) or a thermoplastic that has high strength, rigidity, and impact resistance (e.g., Acrylonitrile butadiene styrene (ABS)), and by various processes (e.g., injection molding).

Example embodiments of cutters (or cutter apparatuses) include multiple cut guides (or guards) that independently drive (reposition) a blade holder (or blade carrier/actuator). By way of example, the cutter apparatus 100 includes cut guides (or guards) 130*a*, 130*b* which are independently operable to drive (reposition) the blade carrier 120 for extending the blade 122 from the housing 102. The cut guides (or guards) 130*a*, 130*b* can be formed of various materials, for example, a material that has high strength and wear resistance (e.g., nylon, or glass-filled nylon), and by various processes (e.g., injection molding).

Figure 4A:
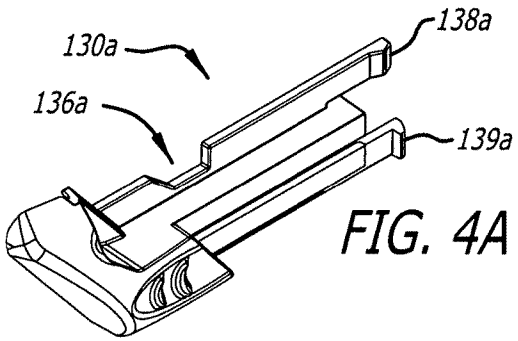
FIG. 4A is a perspective view of a cut guide (or guard) provided at a left side of the cutter apparatus of FIG. 1.
Figure 4E:
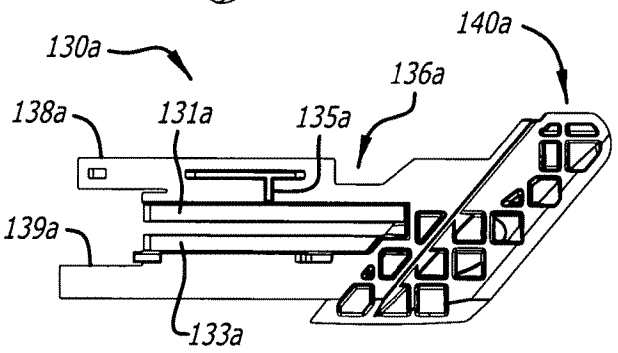
FIGS. 4B-4G are front, left side, back, right side, top, and bottom views of the left side cut guide (or guard)
Figure 4D:
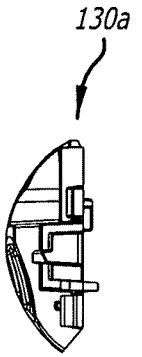
Figure 4F:
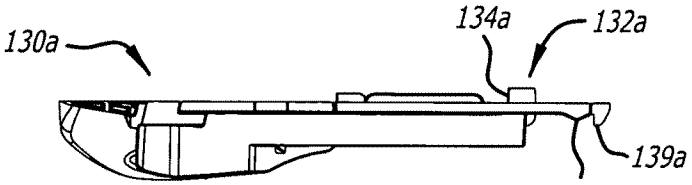
Figure 4C:
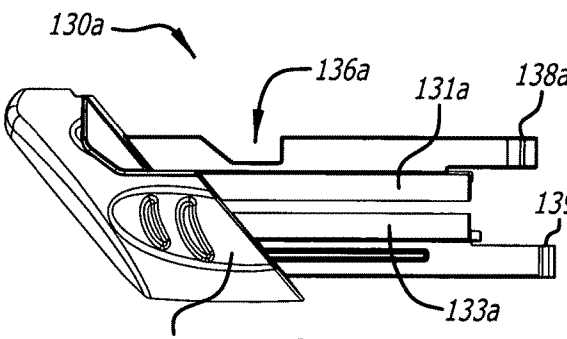
Figure 4B:
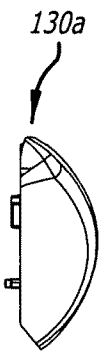
Figure 4G:
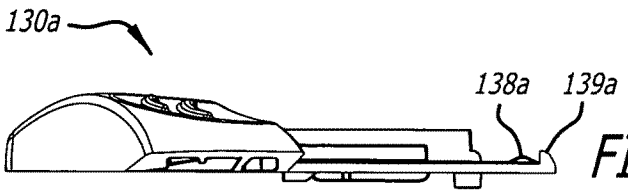
Figure 5A:
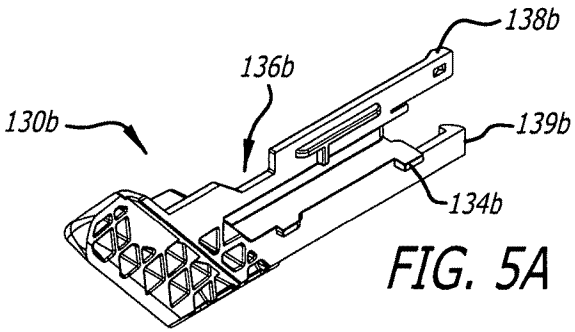
FIG. 5A is a perspective view of a cut guide (or guard) provided at a right side of the cutter apparatus of FIG. 1.
Figure 5E:
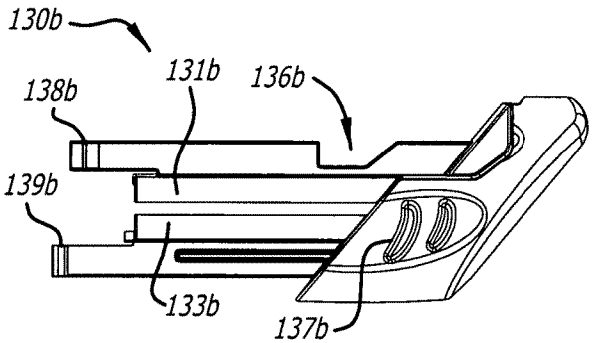
FIGS. 5B-5G are front, left side, back, right side, top, and bottom views of the right side cut guide (or guard)
Figure 5D:
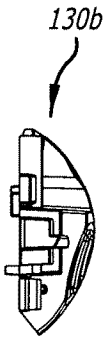
Figure 5F:
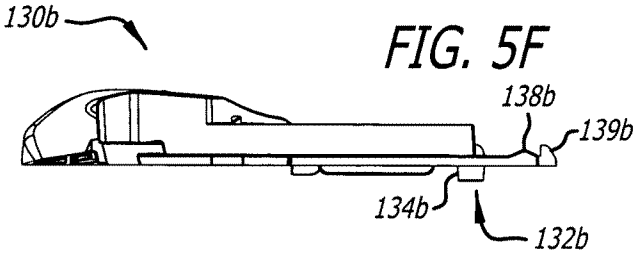
Figure 5C:
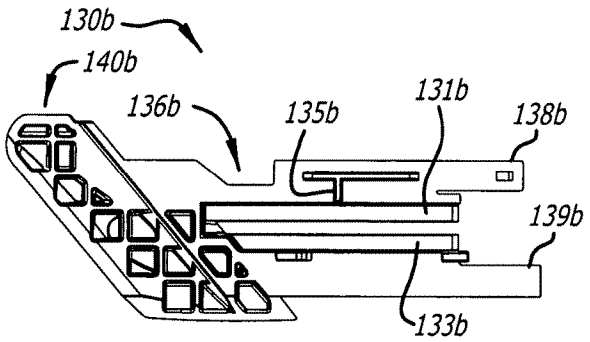
Figure 5B:
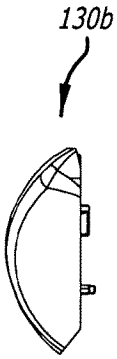
Figure 5G:
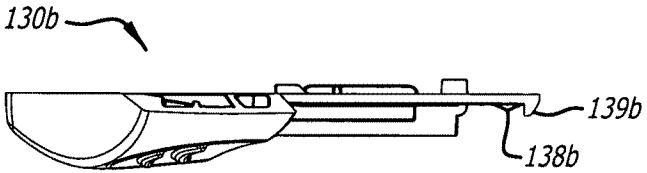

Each or one or more of the cut guides (or guards) includes a portion that is brought into contact with an engagement member/component/element provided by, connected to, or coupled with the blade carrier during blade deployment operations effected utilizing the cut guides (or guards), respectively. Referring additionally to FIGS. 4A-4G and 5A-5G, in example embodiments, each of the cut guides (or guards) 130*a*, 130*b* includes one or more portions (e.g., inclusive of portions 132*a*, 132*b*, respectively) that is brought into contact with the blade carrier during blade deployment operations effected utilizing the cut guides (or guards), respectively, at an engagement location within the housing. The portions 132*a*, 132*b* include laterally (e.g., inwardly) extending tabs 134*a*, 134*b*, respectively, near the bottom rear portion of each cut guides (or guard), which are repositionable entirely within the housing. The aforementioned engagement location can include or be provided by one or more drive surfaces. For example, adjacent drive surfaces 127*a* and 127*b* (of the blade holder 120) are driven by the tabs 134*a*, 134*b*, respectively, depending upon which cut guide (or guard) is deployed. In an example embodiment, the cut guides (or guards) 130*a*, 130*b* further (or optionally or alternatively) include forward-facing surfaces 135*a* (FIG. 4E), 135*b* (FIG. 5C) configured such that the surfaces 135*a*, 135*b* are brought into contact with rearward-facing surfaces 124*a*, 124*b* (at opposite sides, FIGS. 6C and 6E, of the blade holder (or blade carrier/actuator) 120) when the cut guides (or guards) 130*a*, 130*b* are deployed, respectively.

The left side and right side handle portions, and the multiple cut guides (or guards) include, for example, a pair of cut guides (or guards) (slidably) supported by and repositionable in relation to (e.g., along) the left side and right side handle portions, respectively. In example embodiments, the cutter apparatus includes or is provided with an actuator or actuator structure (or actuator portion or element(s)) that is connected to or coupled with the blade carrier and repositionable in relation to (e.g., along) the housing. In example embodiments and implementations, the cut guides (or guards) are not fixedly connected to the blade holder (or blade carrier/actuator).

In example embodiments and implementations, a cutter apparatus includes or is provided with an actuator including a plurality of engagement portions. For example, at least two (or all) of the engagement portions are fixed in position (e.g., fixedly connected), or not repositionable, in relation to each other.

Figure 8:
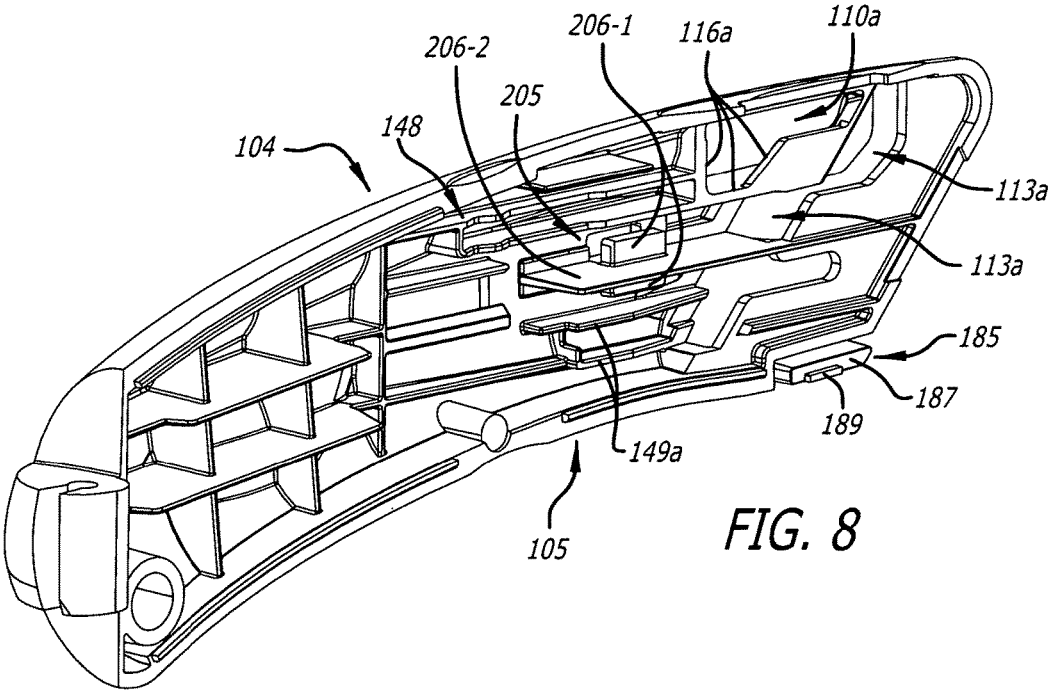
FIG. 8 is a perspective view of an interior portion of a left side housing (or handle) portion of the cutter apparatus of FIG. 1.
Figure 9:
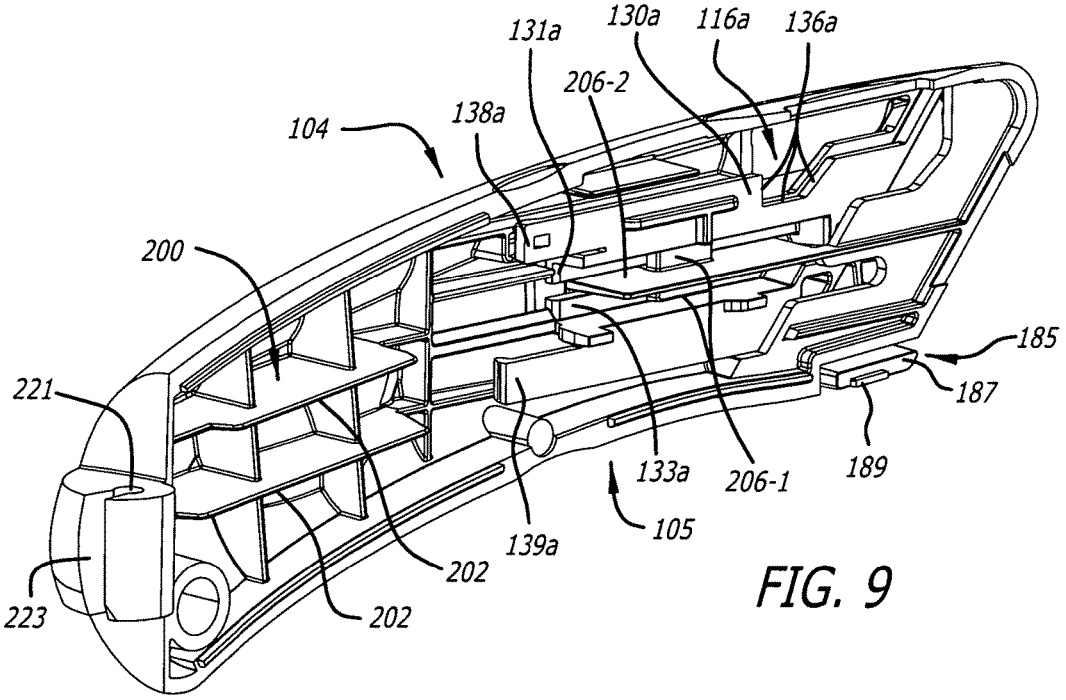
FIG. 9 is a perspective view showing the cut guide (or guard) of FIGS. 4A-4G coupled to and secured within the housing (or handle) portion as shown in FIG. 8.
Figure 10:
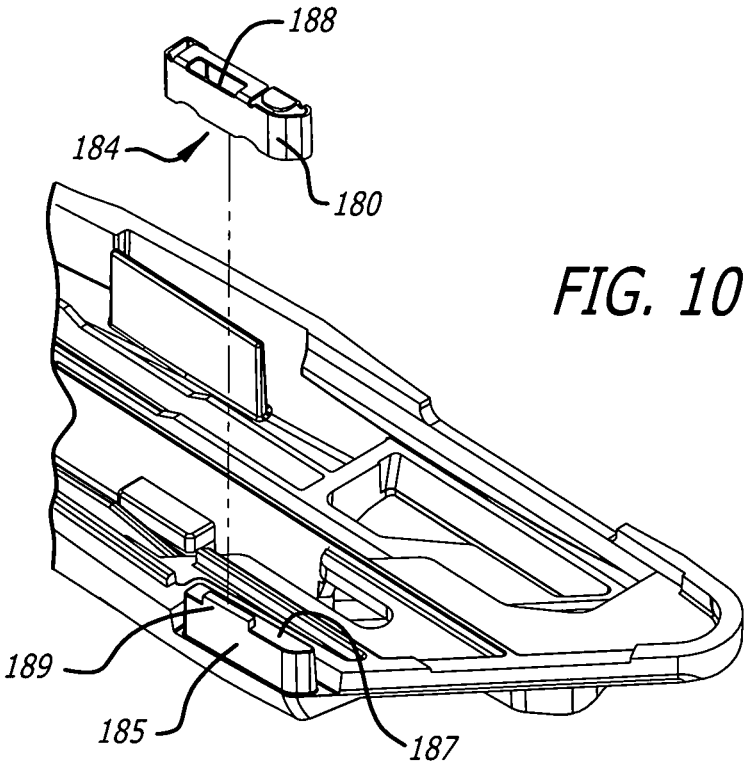
FIGS. 10 and 11 are partial perspective views of the left side housing (or handle) portion showing installation of the wear plate (or wear resistant structure or wear protection portion) of FIGS. 7A-7G at a complementary portion (or complementary support elements or interface structure) of the housing (or handle).
Figure 11:
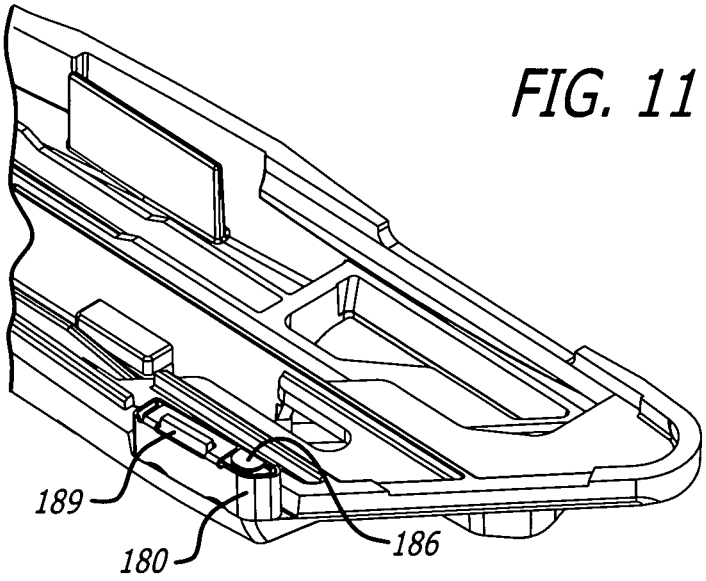
Figure 12A:
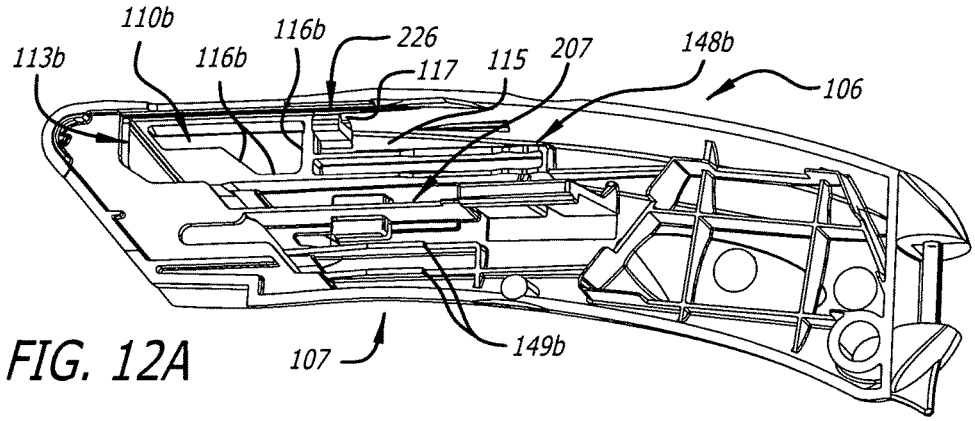
FIG. 12A is a perspective view of an interior portion of a right side housing (or handle) portion of the cutter apparatus of FIG. 1.
Figure 12B:
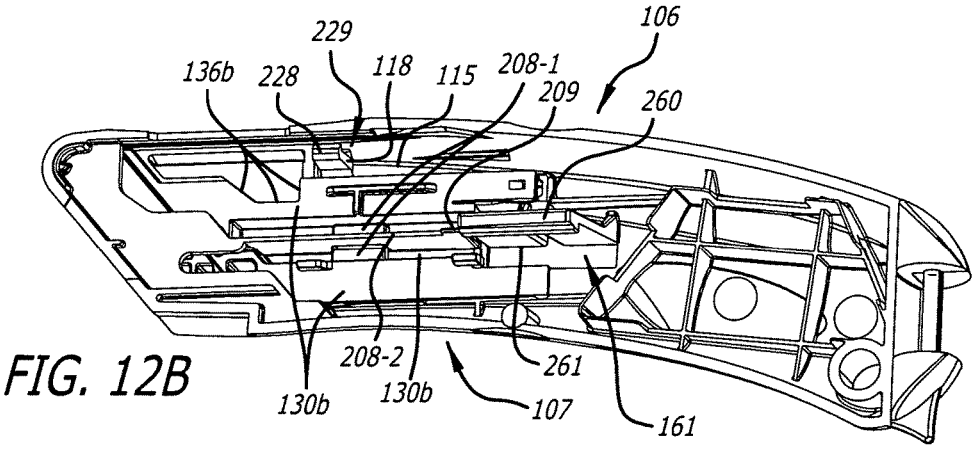
FIG. 12B is a perspective view showing the cut guide (or guard) of FIGS. 5A-5G coupled to and secured within the housing (or handle) portion as shown in FIG. 12A.

The cutter apparatus 100 includes an actuator 150 (e.g., a primary actuator) connected to or coupled with the blade carrier 120 and repositionable along the housing, the actuator including a plurality of (fixedly interconnected) engagement portions including dual engagement portions 152*a*, 152*b* which extend from openings 110*a*, 110*b* in (e.g., along) the left side and right side handle portions 104, 106, respectively. The cut guides (or guards) 130*a*, 130*b* include activation points (or surfaces) 137*a*, 137*b* (see e.g., FIGS. 4C and 5E, respectively). Referring additionally to FIGS. 8 and 12A, the cut guides (or guards) 130*a*, 130*b* include bump spring arms 138*a*, 138*b* which interface (detent) with recesses 148*a*, 148*b* (of the handle portions 104, 106, respectively) to provide resistance so that the cut guide (or guard) is not unintentionally activated with the actuator 150 when tray cuts are made. In an example embodiment, the cut guides (or guards) 130*a*, 130*b* also include hook spring arms 139*a*, 139*b* which are brought into contact with stop surfaces 149*a*, 149*b* (of the handle portions 104, 106, respectively) preventing the cut guides (or guards) from being slid completely out of the body.

Figure 27:
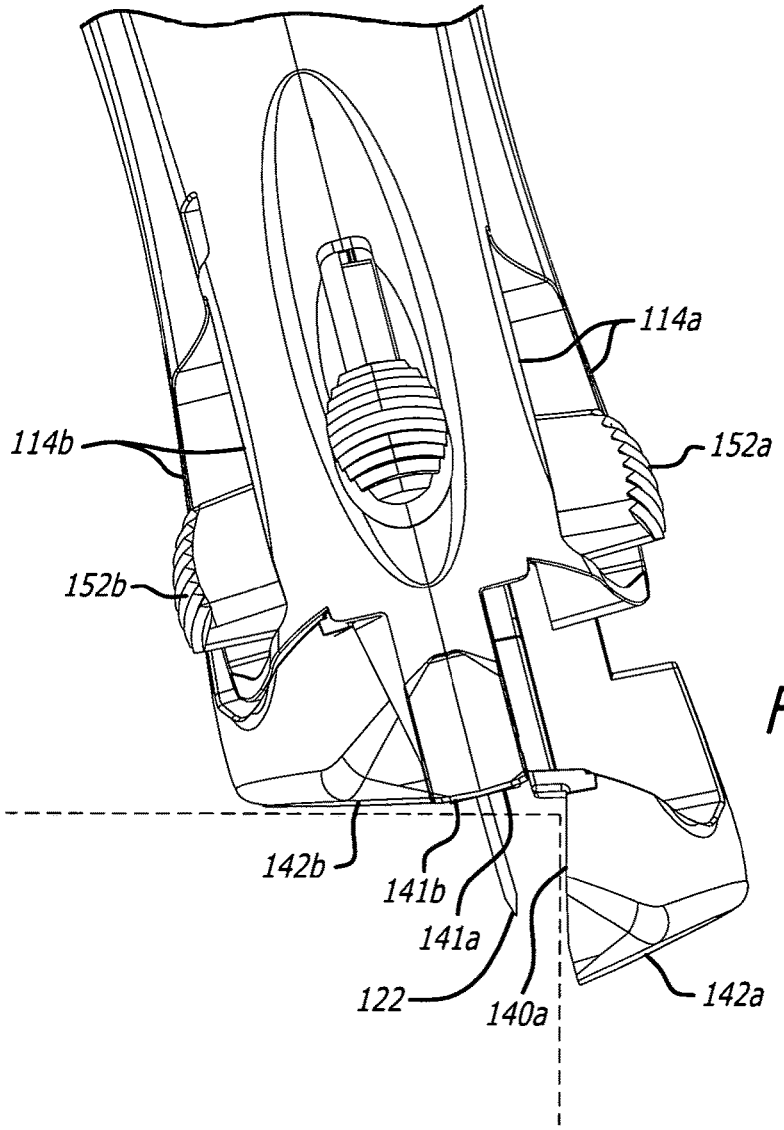
FIG. 27 is a partial perspective view of the cutter apparatus, as depicted in FIG. 26, during a cutting operation showing the left side cut guide (or guard), the actuator or actuator structure, and a blade all in their respective fully extended positions, and the right side cut guide (or guard) remaining in its fully retracted position.
Figure 28:
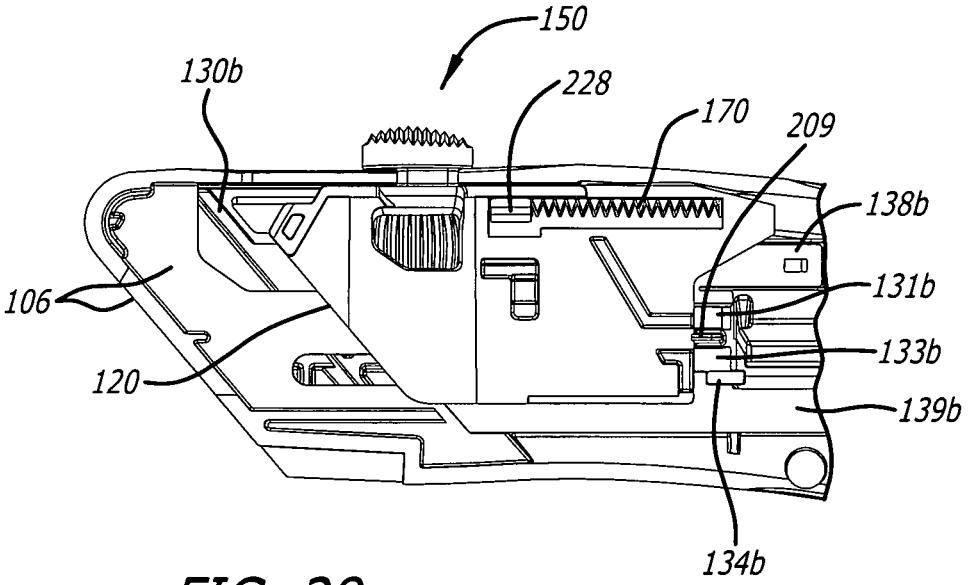
FIG. 28 is a partial (interior) side view of the right side handle portion of the cutter apparatus of FIG. 1 showing the actuator or actuator structure and the right side cut guide (or guard) in their respective fully retracted positions.
Figure 29:
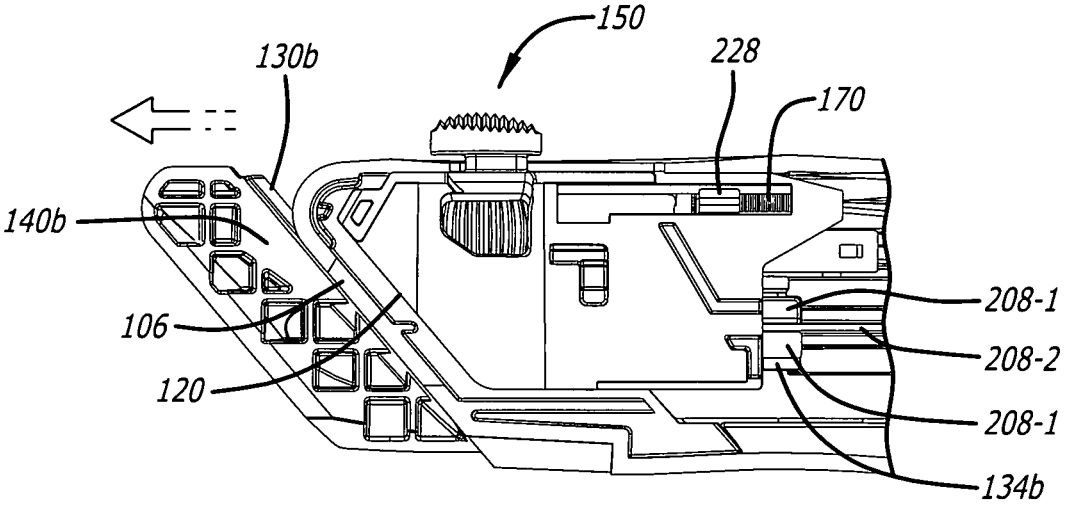
FIGS. 29 and 30 are partial (interior) side and perspective views, respectively, showing the right side cut guide (or guard) distally repositioned and driving the actuator or actuator structure to deploy a blade.
Figure 30:
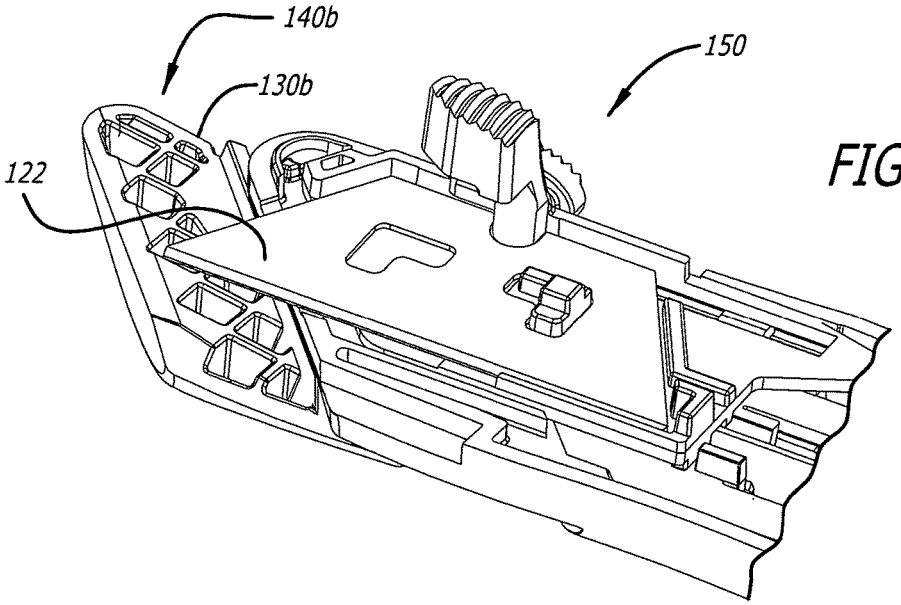
Figure 31:
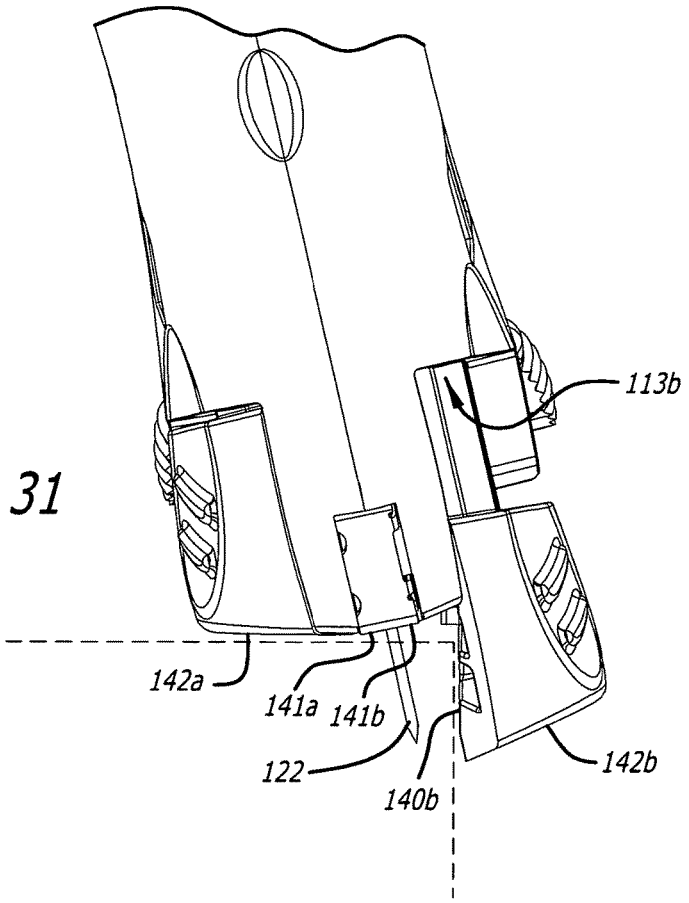
FIG. 31 is a partial perspective view of the cutter apparatus, as depicted in FIGS. 29 and 30, during a cutting operation showing the right side cut guide (or guard), the actuator or actuator structure, and a blade all in their respective fully extended positions, and the left side cut guide (or guard) remaining in its fully retracted position.

In example embodiments and implementations, a cutter apparatus includes or is provided with an actuator (e.g., a primary actuator) that is (slidably supported by the housing and) connected to or coupled with a blade holder (or blade carrier/actuator). Referring additionally to FIG. 27, the actuator can include, for example, dual engagement portions (such as the dual engagement portions 152*a*, 152*b*, for example) that extend laterally (e.g., in opposite directions) beyond edge portions 114*a*, 114*b*, respectively, of openings (the openings 110*a*, 110*b*) along the left side and right side handle portions, respectively. Referring also to FIGS. 1 and 3, the actuator can include one or more additional engagement portions such as a third (top-side) engagement portion 152*c* that extends from an opening 110*c* along a top-side of the cutter apparatus, the opening for example being located between and defined by opposing recessed edge portions/surfaces 111*a*, 111*b* of the left side and right side handle portions 104, 106, respectively. Referring additionally to FIG. 6F, in an example embodiment, the actuator 150 includes laterally extending portions 154*a*, 154*b* (of the engagement portions 152*a*, 152*b*, respectively) and back surfaces 156*a*, 156*b*, 156*c* (of the engagement portions 152*a*, 152*b*, 152 respectively).

Referring to FIGS. 6C, 6F, 12A, 12B and 19, in an example embodiment, the cutter apparatus 100 includes a guide member (or structure) 226 (e.g., extending laterally and inward from the right side handle portion 106 as shown). The guide member (or structure) 226 includes a cantilevered end portion 228 which, with an opposing inside surface 117 (of the right side handle portion 106), defines a channel 229 configured to receive and slidably secure therein a rail (member) 126 of the blade carrier 120. This, and the laterally extending (actuator) portion 154*b* (bottom side thereof and opposing surface of the opening 110*b*), prevents the blade carrier 120 separating from the right side handle portion 106 (when the handle portions 104, 106 are not in their closed configuration). Further with regard to the actuator 150, the back side surface 156*c* (of top-side engagement portion 152*c*) limits rearward movement of the blade carrier 120. The back surfaces 156*a*, 156*b* can also be configured to serve as stops in this manner, except (in this example implementation) for the back surface 156*a* when the handle portions 104, 106 are repositioned away from each other in, or repositioning toward, an open (e.g., blade change) configuration.

In example embodiments and implementations, a cutter apparatus includes a spring operatively connected and/or positioned between the housing and the blade carrier. The cutter apparatus 100 includes, for example, a (single) spring 170 (e.g., a compression spring, configured to compress as the blade carrier 120 is extended forward/distally) and to bias (the blade carrier 120 and) the actuator 150 toward a retracted position in relation to the housing. The spring 170 can be formed of various materials, for example, steel (e.g., music wire, high carbon steel).

The spring can be, for example, operatively connected and/or positioned between portions of the blade carrier and of the housing, respectively. The spring can be laterally supported by portions of the blade holder and of the housing, respectively.

Figure 6A:
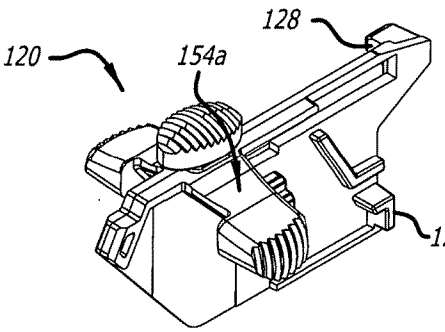
FIG. 6A is a perspective view of a blade holder (or blade carrier/actuator) of the cutter apparatus of FIG. 1.
Figure 6E:
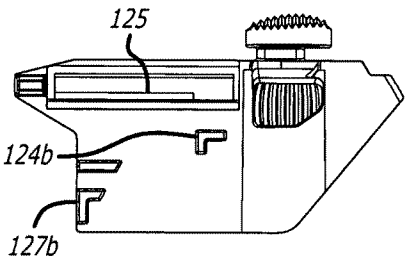
FIGS. 6B-6G are front, left side, back, right side, top, and bottom views of the blade holder (or blade carrier/actuator)
Figure 6D:
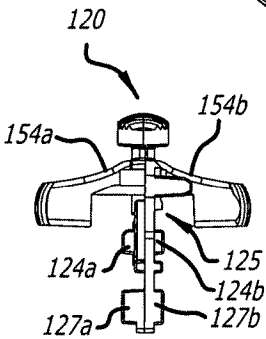
Figure 6F:
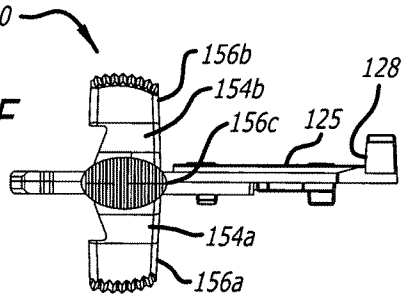
Figure 6C:
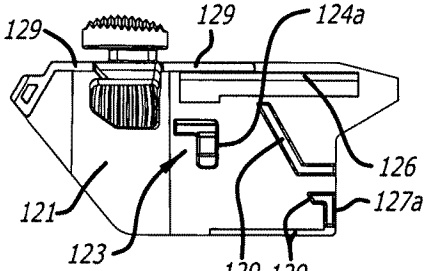
Figure 6G:
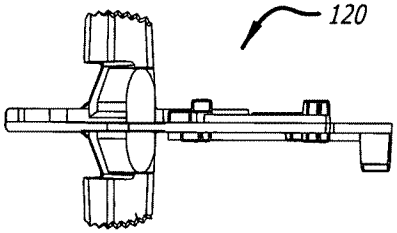
Figure 6B:
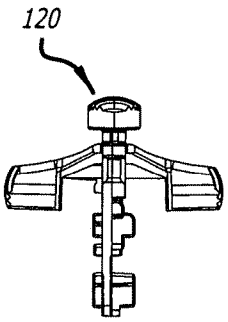
Figure 7A:
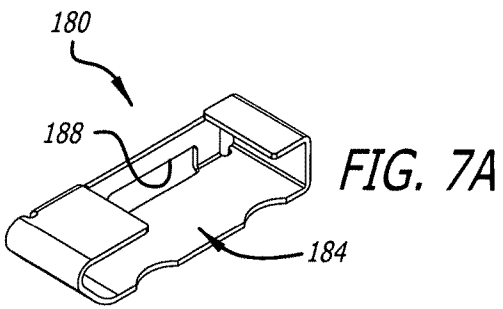
FIG. 7A is a perspective view of a wear plate (or wear resistant structure or wear protection portion) of the cutter apparatus of FIG. 1.
Figure 7E:
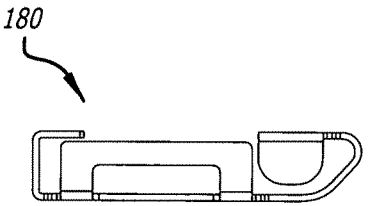
FIGS. 7B-7G are front, left side, back, right side, top, and bottom views of the wear plate (or wear resistant structure or wear protection portion)
Figure 7D:
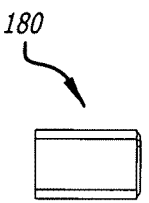
Figure 7F:
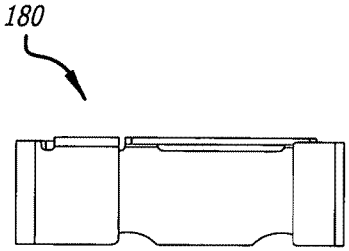
Figure 7C:
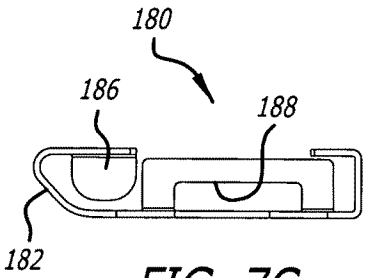
Figure 7G:
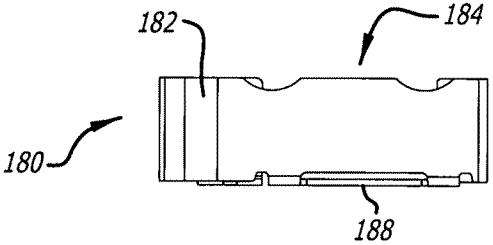
Figure 7B:
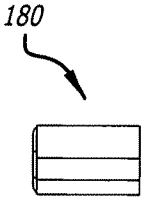

Referring to FIGS. 6A, 6F and 12A, in an example embodiment, the spring 170 is operatively connected and/or positioned between a forward facing portion 128 (of the blade carrier 120) and a rear facing portion 118 (of the guide member 226 that extends from, e.g., integrally formed with, the right side handle portion 106). Additionally, in the illustrated example embodiment, the spring 170 is laterally supported (at/along a side portion thereof) by a (right angled) recess 125 of/defined by the blade carrier 120 and (at/along another side portion of the spring 170) by an inside wall 115 (of the right side handle portion 106). Accordingly, the guide member (or structure) 226, at different portions thereof, serves the purposes/functions of: (with the inside surface 117 of the handle portion 106) defining/providing the channel 229 which is configured to receive and slidably support and secure therein a portion, i.e., the rail (member) 126 of the blade carrier 120; and (with the forward facing portion 128 of the blade carrier 120) providing opposing compressive interfacing elements (of the housing 102 and the blade carrier 120, respectively) at opposite ends of the spring 170.

Thus, in an example embodiment, a cutter apparatus includes a housing shaped to be hand-held, a blade carrier repositionable in relation to the housing and configured to support a blade thereon, and multiple cut guides (or guides) independently operable to drive the blade carrier for extending the blade from the housing. In example embodiments and implementations, the actuator is configured to retract the cut guides (or guards) with it (the actuator) when the actuator is repositioned to a retracted position (of the actuator) in relation to the housing. In example embodiments and implementations, the cut guides (or guards) are configured such that, when the actuator is (held) in a blade deployment position (e.g., a fully extended position in relation to the housing), the cut guides (or guards) are independently retractable and extendable in relation to the housing. In example embodiments and implementations, the blade carrier is repositionable (in relation to the handle portions) to a fully retracted position (at which a blade held thereon is entirely within the housing), the actuator and the cut guides (or guards) being configured such that movement of the actuator to a fully retracted position (e.g., at which a blade held on the blade carrier is entirely within the housing) necessarily also repositions any of the cut guides (or guards) which are not already in a fully retracted (cut guide or guard) position (in relation to the handle) to (their respective) fully retracted position(s). The actuator and the cut guides (or guards) are configured, for example, such that the actuator is repositionable (away from its fully retracted position) in relation to (and independent of) the cut guides (or guards) to deploy a blade (held on, secured to, and/or coupled to the blade carrier). In example embodiments and implementations, the actuator is repositionable (e.g., to a fully extended position) in relation to the handle to a blade deployment position, the actuator and the cut guides (or guards) being configured such that, when the actuator is in the blade deployment position, the cut guides (or guards) are repositionable between retracted and extended (cut guide or guard) positions in relation to the housing. The actuator and the cut guides (or guards) are configured, for example, such that when one or more of the cut guides (or guards) is/are repositioned to the extended (cut guide or guard) position(s), a user of the cutter apparatus can maintain the blade deployment position (of the actuator) by holding either the actuator or any of the one or more cut guides (or guards) in their respective extended (cut guide or guard) positions.

In example embodiments and implementations, a cutter apparatus includes or is provided with an actuator or actuator structure (or actuator portion or element(s)) that is slidably supported by the housing. The actuator or actuator structure can be a primary actuator such as, for example, the actuator 150 which is connected to or coupled with the blade carrier 120 and slidably supported by the housing 102 (e.g., as previously discussed).

In example embodiments and implementations, a cutter apparatus includes or is provided with multiple actuators operable for extending the blade from the housing, the actuators including a primary actuator (e.g., coupled to the blade holder and repositionable in relation to the housing) and at least one auxiliary actuator supported by and repositionable in relation to a handle portion. In example embodiments and implementations, a cutter apparatus includes or is provided with multiple auxiliary actuators provided in the form of cut guides (or guards).

Example embodiments of cutters (or cutter apparatuses) include a housing having left side and right side handle portions, and multiple actuators independently operable for extending a blade from the housing, the actuators including a primary actuator, and a pair of auxiliary actuators (slidably) supported by and repositionable in relation to (e.g., along) the left side and right side handle portions, respectively, the primary actuator including a plurality of (fixedly interconnected) engagement portions including dual engagement portions which extend from openings in (e.g., along) the left side and right side handle portions, respectively.

Figure 17:
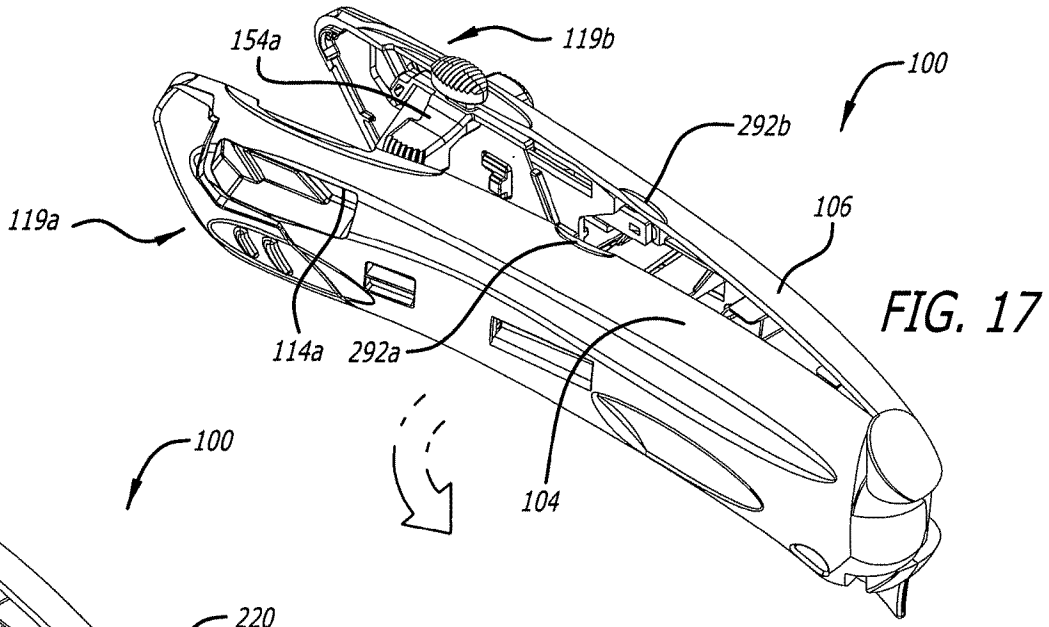
FIGS. 17 and 18 are perspective views showing the housing (or handle) portions, depicted in FIG. 15, being repositioned away from each other, after the release/engagement mechanism (interface) has been moved to its released or unlatched configuration, and in an open configuration, respectively.

The cut guides (or guards) 130*a*, 130*b* are coupled to (and repositionable in relation to) distal portions 119*a*, 119*b* (FIG. 17) of the handle portions 104, 106, respectively, and independently operable for extending a blade from the housing. Referring additionally to FIGS. 8, 9, 12A and 12B, in an example embodiment, the cut guides (or guards) 130*a*, 130*b* extend from openings 113*a*, 113*b* (at respective distal portions, e.g., as shown) of the handle portions 104, 106.

Inside (or interior) portions 105, 107 (of the left and right side handle portions 104, 106) include or are provided with inwardly extending structures 205, 207, respectively. The inwardly extending structure 205 (FIGS. 8 and 9) includes support elements 206-1, 206-2 (e.g., horizontal fin and upwardly and downwardly extending vertical members, orthogonally configured as shown) that slidably support the cut guide (or guard) 130*a*. In an example embodiment, the support elements 206-1 and surfaces defining the opening 113*a* laterally support the left side cut guide (or guard) 130*a*, and the support element 206-2 is positioned between track portions 131*a* and 133*a* (FIGS. 4C and 4E) along the cut guide (or guard) 130*a* that define a vertical support channel therebetween. The inwardly extending structure 207 (FIGS. 12A and 12B) includes support elements 208-1, 208-2 (e.g., horizontal fin and upwardly and downwardly extending vertical members, orthogonally configured as shown) that slidably support the cut guide (or guard) 130*b*. In an example embodiment, the support elements 208-1 and surfaces defining the opening 113*b* laterally support the right side cut guide (or guard) 130*b*, and the support element 208-2 is positioned between track portions 131*b* and 133*b* (FIGS. 5C and 5E) along the cut guide (or guard) 130*b* that define a vertical support channel therebetween. The inwardly extending structure 207 additionally includes a laterally projecting portion (or stop) 209 which can be configured as an additional back stop for limiting rearward movement of the blade holder 120.

In example embodiments and implementations of a cutter apparatus including multiple independently operable cut guides (or guards), one of the cut guides (or guards) includes or is provided with an aperture that coaligns or registers with an opening in a handle side or other portion of the housing within which the one cut guide is slidably supported to allow a portion of the housing to reposition away from another portion of the housing. By way of example, the one cut guide is repositionable to facilitate a blade change operation. In an example embodiment, the cut guides (or guards) include or consist of a pair of cut guides (or guards), and the cutter apparatus further includes an actuator connected to or coupled with the blade carrier, the actuator including a laterally extending portion (such as, for example, the laterally extending portion 154*a*) configured to allow, only in a safety configuration in which the actuator and both cut guides are in fully retracted positions, the portion of the housing within which said one cut guide is slidably supported to be disengaged from said another portion of the housing. In example embodiments and implementations, another of the cut guides (or guards) is slidably supported within said another portion of the housing. In an example embodiment, the cut guides (or guards) include or consist of a pair of cut guides (or guards), and the cutter apparatus further includes an actuator connected to or coupled with the blade carrier, the blade carrier and said another cut guide being secured to said another portion of the housing independent of whether the cutter apparatus is in a safety configuration in which the actuator and both cut guides are in fully refracted positions and at which coaligned features of a laterally extending portion of the actuator and of said portion of the housing and said one cut guide allow said portion of the housing within which said one cut guide is slidably supported to reposition away from said another portion of the housing.

Referring to FIGS. 1-3, 17 and 18, the handle portions 104, 106 can be shaped and/or adapted to interfit together (e.g., in a closed configuration), the handle portions providing a handle base 112. In example embodiments and implementations, a cutter apparatus includes or is provided with surfaces/structures for interfitting the handle portions 104, 106. By way of example, such surfaces/structures can include rails 296, 297 at a base portion of cutter, a rail 298 at the bottom side distal portion of the handle portion 104, a rail 299 at the distal tip at the top side of the handle portion 106, and respective complementary surfaces/structures at opposing portions of the cutter housing.

Figure 13:
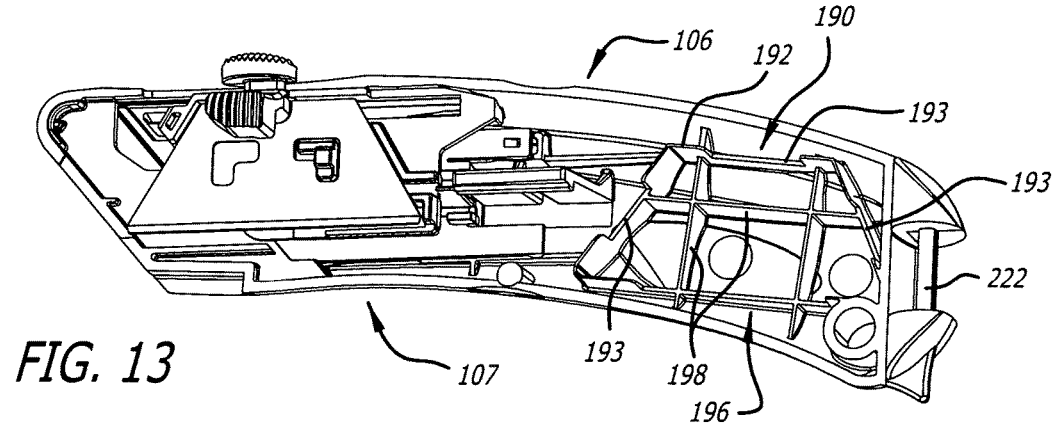
FIG. 13 is a perspective view showing the blade holder (or blade carrier/actuator) of FIGS. 6A-6G coupled to the right side housing (or handle) portion.

Referring additionally to FIG. 13, the cutter apparatus 100 includes a pivot interface 220 provided by complementary surfaces of the handle portions, namely, a cylindrical channel 221 and a pivot post 222, which (during assembly of the cutter apparatus) is advanced through slot 223 and located (e.g., snap fit) into the cylindrical channel 221. The pivot interface 220 is configured to allow a user of the cutter apparatus to pivotally reposition the handle portions 104, 106 away from each other (e.g., up to a maximum pivot angle that defines a handle portions fully opened and/or blade change configuration at which respective surfaces of the handle portions 104, 106 contact each other preventing pivoting beyond the maximum angle).

Thus, in an example embodiment, a cutter apparatus includes a housing shaped to be hand-held, the housing including handle portions shaped and/or adapted to interfit together, the handle portions providing a handle base, and cut guides coupled to the handle portions, respectively, and independently operable for extending a blade from the housing, the handle portions each being structurally rigid and/or nonfoldable from the handle base to openings (such as, for example, the openings 113*a*, 113*b* at distal portions) of the handle portions from which the cut guides extend, respectively.

Thus, in an example embodiment, a cutter apparatus includes a housing shaped to be hand-held, the housing including left side and right side handle portions, a blade holder (coupled to and repositionable in relation to the housing and) configured to support a blade, and multiple actuators independently operable for extending the blade from the housing, the actuators including a primary actuator coupled to the blade holder and repositionable along the housing, and a pair of auxiliary actuators (slidably) supported by and repositionable in relation to (e.g., along) the left side and right side handle portions, respectively, the primary actuator including a plurality of (fixedly interconnected) engagement portions including dual engagement portions which extend from openings in (e.g., along) the left side and right side handle portions, respectively. In example embodiments and implementations, the primary actuator is (slidably supported by the housing and) directly connected to the blade holder. The dual engagement portions (such as the dual engagement portions 152*a*, 152*b*, for example) extend laterally (e.g., in opposite directions) beyond edge portions (such as the edge portions 114*a*, 114*b*, for example; FIG. 27) of said openings along the left side and right side handle portions, respectively. In example embodiments and implementations, the (dual) engagement portions are above (closer to a top side 109 of the cutter apparatus than) the auxiliary actuators (independent of whether the blade is deployed and/or independent of whether one or more of said auxiliary actuators is repositioned in relation to the handle portions). In example embodiments and implementations, the primary actuator further includes a third (top-side) engagement portion that extends from an opening along a top-side of the cutter apparatus, said opening being located for example between and defined by (opposing recessed edge portions/surfaces of) the left side and right side handle portions. In example embodiments and implementations, at least two (or all) of the engagement portions are fixed in position (e.g., fixedly connected), or not repositionable, in relation to each other. In example embodiments and implementations, the auxiliary actuators are cut guides (or guards). In example embodiments and implementations, the auxiliary actuators are not fixedly connected to the blade holder (or blade carrier/actuator).

In example embodiments and implementations, a cutter apparatus includes a (single) spring (e.g., a compression spring, configured to compress as the blade holder is extended forward/distally) operatively interconnected between the blade holder and the housing and configured to bias (the blade holder and) the primary actuator toward a retracted position in relation to the housing. For example, the spring is operatively connected and/or positioned between the housing and the blade carrier, the spring being laterally supported by a recessed portion of the blade holder, and by an inside wall of the right-side housing. In an example embodiment described herein (and as previously discussed), the spring 170 is laterally supported (at/along a side portion thereof) by a (right angled) recess 125 of/defined by the blade carrier 120 and (at/along another side portion of the spring 170) by an inside wall 115 (of the right side handle portion 106). In example embodiments and implementations, the primary actuator further includes a biasing mechanism constituting a single spring configured to retract both the primary actuator and the auxiliary actuators. In example embodiments and implementations, the primary actuator is configured to retract the auxiliary actuators with the primary actuator when the primary actuator is repositioned to a refracted position (of said primary actuator) in relation to the housing. In example embodiments and implementations, the auxiliary actuators are configured such that, when the primary actuator is (held) in a blade deployment position (e.g., a fully extended position in relation to the housing), the auxiliary actuators are independently retractable and extendable in relation to the housing. In example embodiments and implementations, the primary actuator and the auxiliary actuators (e.g., cut guides/guards) are configured such that movement of the primary actuator to a fully retracted primary actuator position (e.g., at which a blade held on the blade holder is entirely within the housing) necessarily also repositions any of said auxiliary actuators which are not already in a fully retracted auxiliary actuator position to said fully retracted auxiliary actuator position(s). The primary actuator and the auxiliary actuators (e.g., cut guides/guards) are configured, for example, such that the primary actuator is repositionable (away from its fully retracted position) in relation to (and independent of) the auxiliary actuators to deploy a blade. In example embodiments and implementations, the primary actuator is repositionable (e.g., to a fully extended position) in relation to the handle to a blade deployment position, the primary actuator and the auxiliary actuators (e.g., cut guides/guards) being configured such that, when the primary actuator is in the blade deployment position, the auxiliary actuators are repositionable between retracted and extended (auxiliary actuator) positions in relation to the housing. The primary actuator and the auxiliary actuators (e.g., cut guides/guards) are configured, for example, such that when one or more of the auxiliary actuators is/are repositioned to said extended (auxiliary actuator) position(s), a user of the cutter apparatus can maintain said blade deployment position (of the primary actuator) by holding either the primary actuator or any of said one or more auxiliary actuators in their respective extended (auxiliary actuator) positions.

Referring to FIGS. 3, 4C, 4E, 5C, 5E, 8, 9, 12A and 12B, in example embodiments and implementations, the cut guides (or guards) 130*a*, 130*b* include a safety aperture 136*a*, 136*b*, respectively, that only coaligns or registers with an opening 116*a*, 116*b* in the cutter apparatus to allow the housing portions 104, 106 to be brought together to the closed configuration when the cut guides (or guards) 130*a*, 130*b* are in fully retracted positions.

In example embodiments and implementations, one of said auxiliary actuators includes an aperture that coaligns or registers with an opening in a handle side or other portion of the housing within which said one auxiliary actuator is slidably supported to allow a portion of the housing to reposition away (e.g., pivotally, at a pivot interface at a base portion of the housing) from another portion of the housing. In example embodiments and implementations, said one auxiliary actuator is repositionable to facilitate a blade change operation. In example embodiments and implementations, the primary actuator includes a laterally extending portion configured to allow, only in a safety configuration in which the primary actuator and both auxiliary actuators are in fully retracted positions, said portion of the housing within which said one auxiliary actuator is slidably supported to be disengaged from another portion of the housing. In example embodiments and implementations, another of said auxiliary actuators is slidably supported within said another portion of the housing. In example embodiments and implementations, the blade holder and said another auxiliary actuator are secured to said another portion of the housing independent of whether the cutter apparatus is in a safety configuration in which the primary actuator and both auxiliary actuators are in fully retracted positions and at which coaligned features of the primary actuator and of said portion of the housing and said one auxiliary actuator allow said portion of the housing to reposition away from said another portion of the housing.

Referring to FIGS. 8-11, in an example embodiment, the cutter apparatus 100 includes a wear plate 180 with a curved portion 182 (e.g., complementary to adjacent handle portion surfaces, as shown). An interior (or opening) 184, e.g., formed by the outer walls/portions of the plate 180, configured as shown, is sized and shaped to receive a complementary portion 185 of the housing therein, with a side portion 186 (of the plate 180) locating against the side 187 of the housing portion 185. A tab (e.g., a melt tab) 189 of the housing portion 185 aligns in relation to and advances through an additional opening 188 of the plate 180. The wear plate 180 can be formed of various materials, for example, a material made of or including a metal (or a metal alloy or a plastic) that has high strength and wear resistance (e.g., stainless steel), and by various processes (e.g., progressive die stamping).

Figure 18:
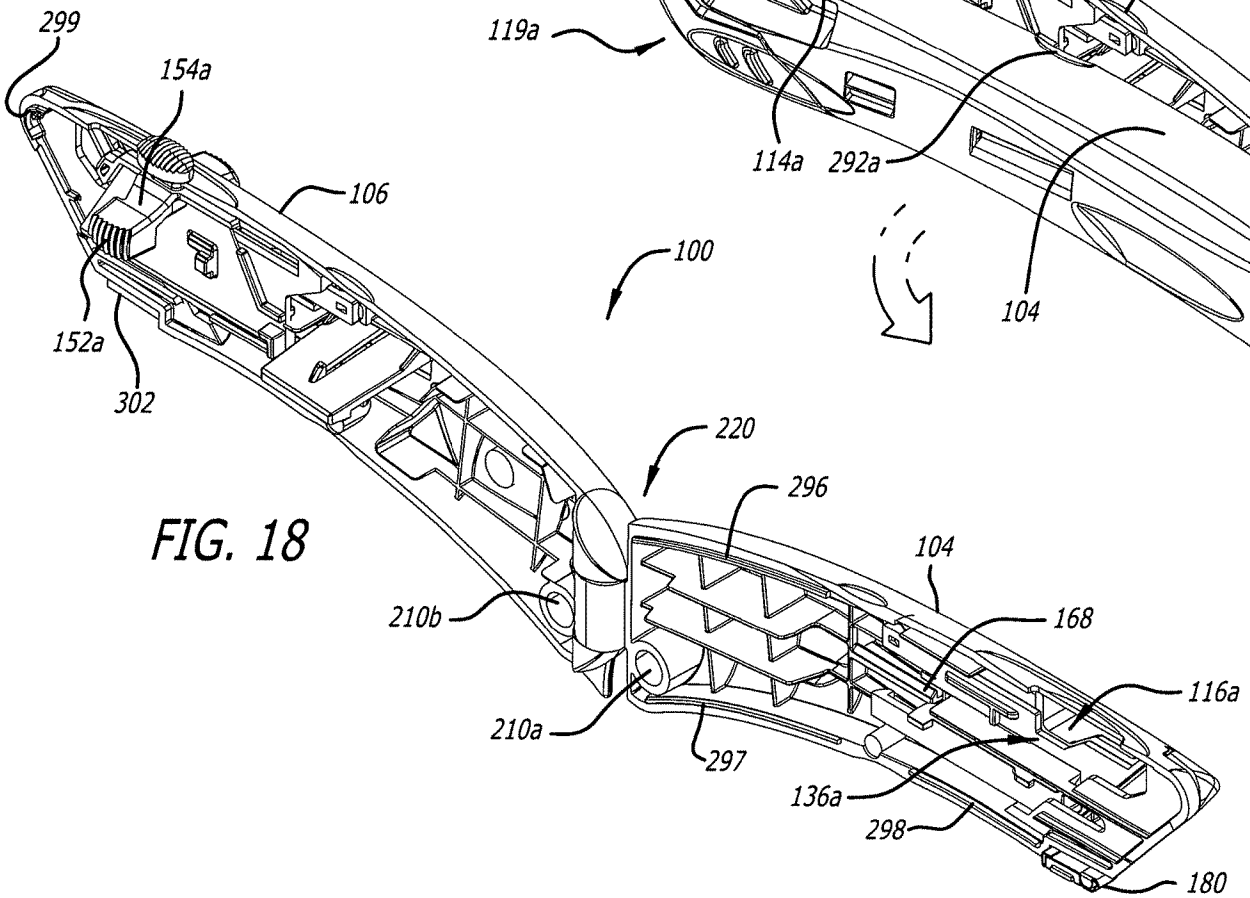
Figure 19:
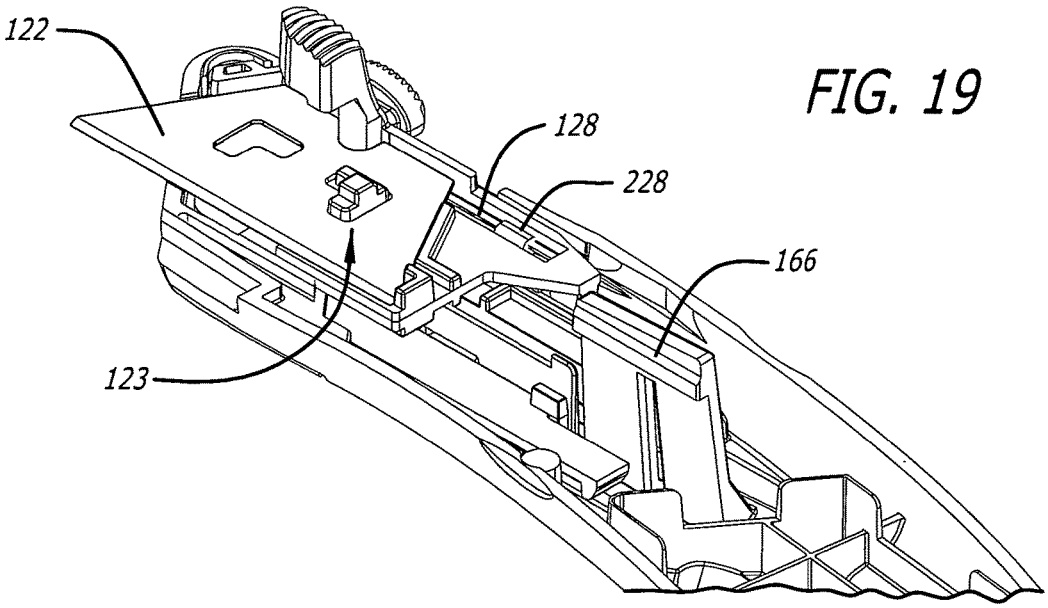
Figure 20:
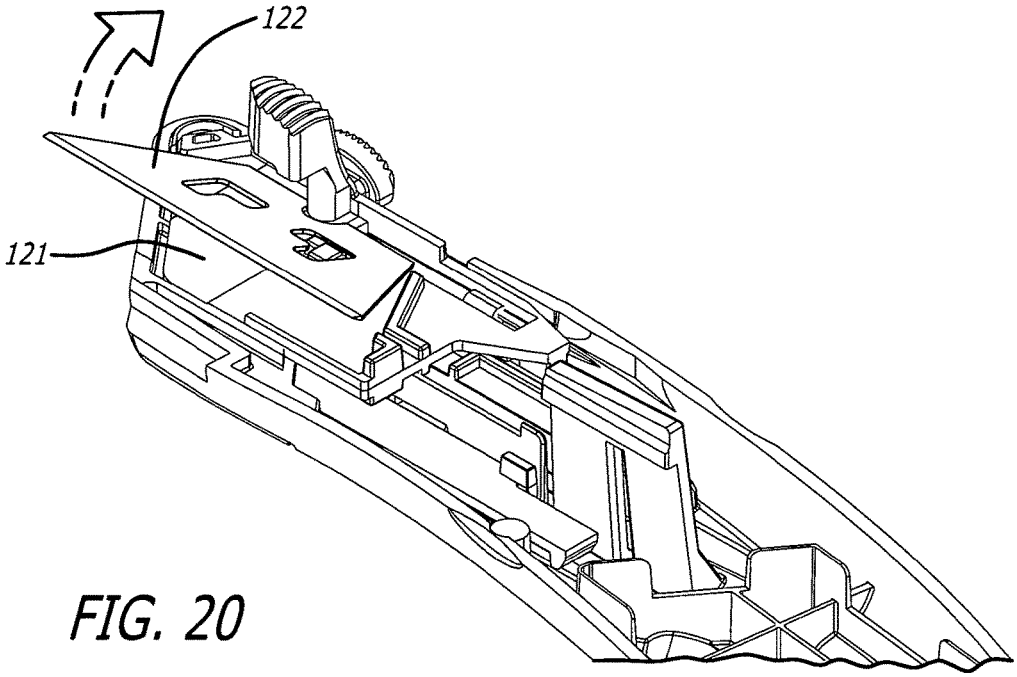
Figure 23:
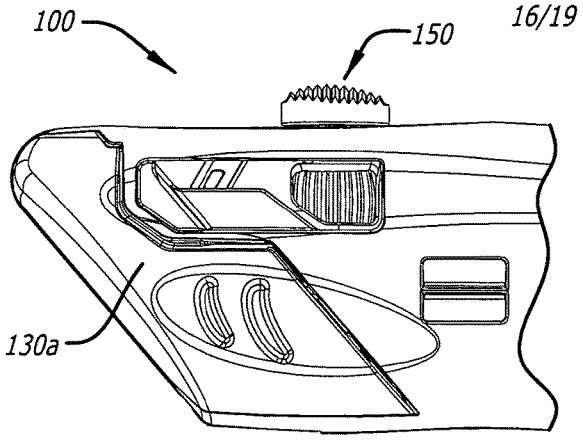
FIG. 23 is a partial left side view of the cutter apparatus of FIG. 1 showing an actuator or actuator structure and the cut guides (or guards) all in their respective fully retracted positions.
Figure 24:
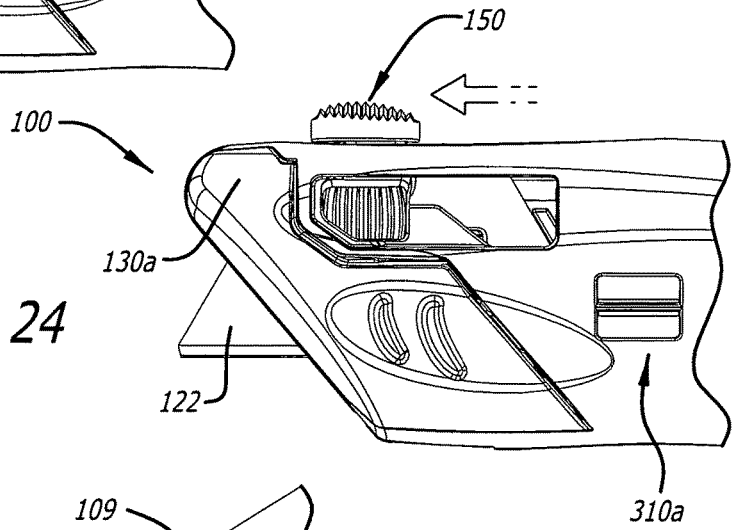
FIGS. 24 and 25 are partial left side and perspective views, respectively, showing the actuator or actuator structure distally repositioned deploying a blade, the cut guides (or guards) remaining in their fully retracted positions.
Figure 25:
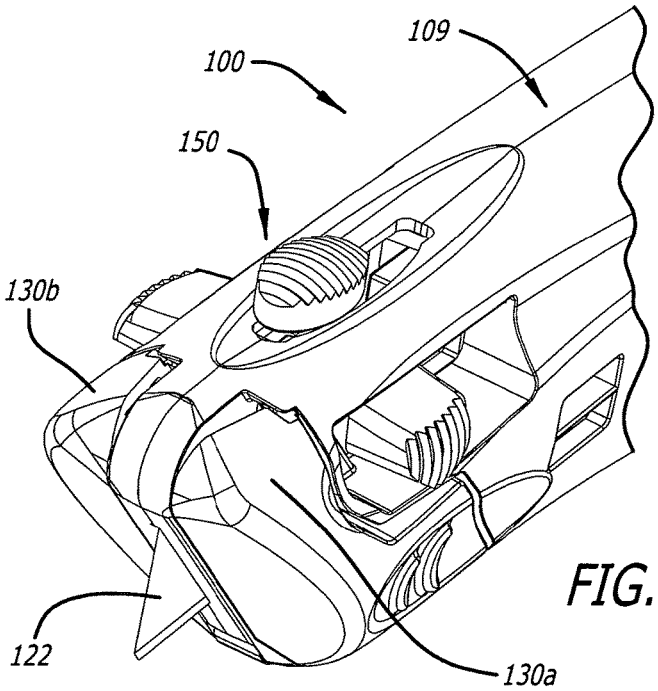
Figure 26:
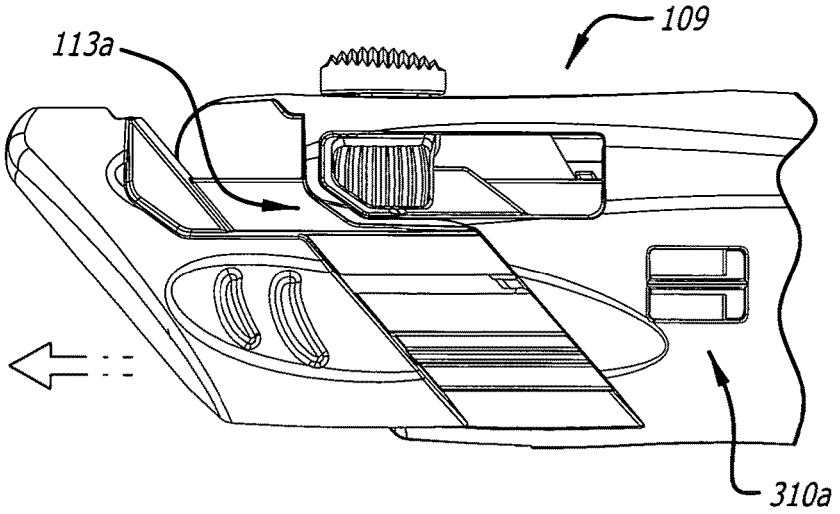
FIG. 26 is a partial left side view of the cutter apparatus of FIG. 1 showing the left side cut guide (or guard) distally repositioned and driving the actuator or actuator structure to deploy a blade.

Referring to FIG. 13, in an example embodiment, the cutter apparatus 100 includes a spare blades receptacle 190 in the form of a blade perimeter wall 192 (e.g., provided as shown) including recessed wall portions 193 (at top, left and right sides of the wall 192). The spare blades receptacle 190 includes a (first blade side) support structure 196, e.g., orthogonal support members 198, all of the same height, as shown, and (referring additionally to FIGS. 8 and 9) the opposite housing portion includes a (second blade side) support structure 200, e.g., parallel support members 202, all of the same height, as shown, that fit within the blade perimeter wall 192 when the handle portions 104, 106 are in their closed configuration. The spare blades receptacle 190, in this example, is provided as part of the handle portion 106 (i.e., the same handle portion to which the blade carrier is secured), and the parallel support members 202 are provided at the handle portion 104 (i.e., the opposite handle portion) to decrease the chance of spare blades repositioning out of the receptacle when the housing portions are being repositioned/moved to an open configuration. Referring additionally to FIG. 18, in an example embodiment, the handle portion 104, 106 include cylindrical channels 210*a*, 210*b*, respectively (e.g., provided at the handle base, as shown) suitable for receiving a lanyard therein.

Example embodiments of cutters (or cutter apparatuses) include a lock/unlock mechanism for handle portions thereof, the lock/unlock mechanism (or device) including/utilizing—portions of the cutter (or cutter apparatus) including—an actuator or actuator structure (or actuator portion or element(s)), cut guide(s)/guard(s), and handle portion(s).

Example embodiments of cutters (or cutter apparatuses) include a release/engagement member (or mechanism) for disengaging/securing together housing/handle portions of the cutter, the release/engagement member (or mechanism) being accessible via an opening in a side portion of the cutter (or cutter apparatus).

Referring to FIG. 14A, in an example embodiment, a release/engagement mechanism (interface) 250 is shown in a latched or engaged configuration at which the housing (or handle) portions are secured together. Referring additionally to FIGS. 14B and 15, the release/engagement mechanism (interface) 250 is, and includes a release member 260 that is, accessible when the handle portions 104, 106 are in a closed configuration via an opening 160 in a side portion of the housing. The release member 260 (e.g., a latch device, visible in the opening 160) is repositionable (e.g., upward flexing within the opening 160 toward a top side of the housing/handle). The release member 260 includes a recessed portion 262 that provides a gap or separation (e.g., as shown) between the release member 260 and a bottom outer edge 162 (of the opening 160). In example embodiments and implementations, release/engagement mechanism (interface) 250 is part of (e.g., integrally formed as a portion of), coupled with, or connected to an opposite side of the housing in relation to the opening 160. For example, and referring also to FIGS. 2 and 12B, the release/engagement mechanism includes a portion 261 (and opening 161 therebelow in the handle portion 106) coupling or connecting the release member 260 to the right side handle portion 106 and extending inwardly from the right side handle inside portion 107 (e.g., as shown). The release/engagement mechanism includes a latch (device) or latch portion 270 with an inward-facing surface (an engagement portion) 272 that engages an outward-facing surface 164 of the housing to secure the handle portions together. In an example embodiment, the release/engagement mechanism (e.g., inclusive of portion 261) is integrally formed with the handle portion 106 (e.g., as shown) and configured to be repositionable upward a sufficient amount, responsive to a user of the cutter apparatus actuating (e.g., via finger contact) the release member 260 to flex upward in relation to the opening 160 (against the downwardly directed engaging bias of the member) to facilitate disengagement of the latch surface 272 from housing/handle surface 164. In an example embodiment, the release/engagement mechanism includes a contact surface 280 (e.g., beveled/angled surface) that is repositionable upward in relation to a top side/portion of the cutter apparatus responsive to upward movement (denoted by arrow 290, see FIG. 15) of the release member 260 to be brought to bear against (and in turn reposition) a portion 292 of the cutter apparatus (e.g., an interior, flexible or otherwise repositionable, portion provided as shown) to facilitate disengagement of the latch surface 272 from housing/handle surface 164, which allows the portions of the cutter to be pulled, e.g., pivotally repositioned, away from each other. Referring to FIGS. 1, 2 and 14B, in an example embodiment, the handle portions 104, 106 include (define) top side surfaces 292*a*, 292*b* and bottom side surfaces 294*a*, 294*b* (e.g., recessed with complementary contoured structures) suitable for engaging with a finger or thumb for urging the handle portions apart.

Thus, in an example embodiment, a cutter apparatus includes a housing shaped to be hand-held, the housing including first and second handle portions (e.g., left side and right side handle portions) shaped and/or adapted to interfit together, a blade holder configured to support a blade, and a lock/unlock mechanism for securing the handle portions together (e.g., in a closed configuration), the lock/unlock mechanism including multiple actuators (independently) operable for extending the blade from the housing, the actuators including a primary actuator coupled to the blade holder and repositionable in relation to (e.g., along) the housing, and at least one auxiliary actuator (e.g., a pair of auxiliary actuators) including a first auxiliary actuator (slidably) supported by and repositionable in relation to (e.g., along) the first handle portion, the primary and auxiliary actuators being biased toward and/or repositionable to respective locations (, namely, an unlock configuration,) at which an aperture of the first auxiliary actuator (substantially) coaligns or registers with an opening in the first handle portion in an unlock configuration (of the cutter apparatus) that allows a user of the cutter apparatus to reposition the first handle portion away (e.g., pivotally, at a pivot interface at a base or other portion of the housing) from the second handle portion (or vice versa). In example embodiments and implementations, the primary and auxiliary actuators are in fully refracted positions in the unlock configuration. In example embodiments and implementations, the at least one auxiliary actuator includes one or more cut guides (or guards). In example embodiments and implementations, the at least one auxiliary actuator (e.g., including one or more cut guides or guards) is/are configured to drive the primary actuator to extend the blade. In example embodiments and implementations, the primary actuator is (slidably) coupled to the second handle portion and remains coupled to the second handle portion after the first and second handle portions are repositioned away from each other (and are no longer in the closed configuration). In example embodiments and implementations, the first auxiliary actuator is slidably supported within the first handle portion. In an example embodiment, the primary actuator includes a (generally) laterally extending portion (such as, for example, the laterally extending portion 154*a*) configured to allow, only in the unlock configuration (in which the primary and auxiliary actuators are in their fully retracted positions), coaligned features/structures/surfaces of the first auxiliary actuator and the first handle portion to reposition along the laterally extending portion (away from the second handle portion, as the first and second handle portions are pulled apart by a user of the cutter apparatus). In an example embodiment, the at least one auxiliary actuator (further) includes a second auxiliary actuator (slidably) supported by and repositionable in relation to (e.g., along) the second handle portion, the blade holder (and/or primary actuator) and the second auxiliary actuator being secured to the second handle portion independent of whether the cutter apparatus is in the unlock configuration or whether the first and second handle portions are interfitted together in a closed configuration. In example embodiments and implementations, the second auxiliary actuator is slidably supported within the second handle portion by an inwardly extending structure of, coupled to or associated with the second handle portion. The inwardly extending structure can include, for example, orthogonal support members (e.g., such as previously described). In example embodiments and implementations, the second handle portion includes or is coupled to a guide member (such as, for example the guide member (or structure) 226) that slidably secures the blade holder to the second handle portion. In example embodiments and implementations, the primary actuator includes a plurality of (fixedly interconnected) engagement portions including dual engagement portions which extend from openings in (e.g., along) the first and second handle portions, respectively. In example embodiments and implementations, the primary actuator and the at least one auxiliary actuator are configured such that movement of the primary actuator to a fully retracted primary actuator position (e.g., at which a blade held on the blade holder is entirely within the housing) necessarily also retracts any auxiliary actuator not already in a fully retracted auxiliary actuator position. Moreover, such a primary actuator can be repositionable (away from the fully retracted position) in relation to (and independent of) the at least one auxiliary actuator to deploy a blade (held on, secured to, and/or coupled to the blade holder). In example embodiments and implementations, the primary actuator is repositionable (e.g., to a fully extended position) in relation to the housing to a blade deployment position, the primary actuator and the at least one auxiliary actuator being configured such that, when the primary actuator is in the blade deployment position, the at least one auxiliary actuator is repositionable between retracted and extended auxiliary actuator positions in relation to the housing. The primary actuator and the at least one auxiliary actuator can be configured, for example, such that when the first and second handle portions are interfitted together in a closed configuration and the at least one auxiliary actuator is repositioned to said extended auxiliary actuator position, a user of the cutter apparatus can maintain said blade deployment position (of the primary actuator) by holding either the primary or any of said auxiliary actuator(s) in their respective extended positions.

Referring to FIGS. 14A and 14B, in an example embodiment, adjacent to the recessed portion 262, the latch (device) 270 includes an angled portion, angled guide surface 166, which, in addition to providing/defining the aforementioned gap, is brought into contact with an inward-facing angled surface 168 adjacent to the opening 160 (in the side of housing) within which the latch device is repositionable (e.g., flexed upward toward a top side of the housing/handle). In example embodiments and implementations, a release/engagement mechanism includes/is provided by a release member (such as, for example, the release member 260) which is visible in the opening 160, a latch (device) or latch portion (e.g., a cantilevered latch portion) configured to secure the handle portions together, and (at an opposite side thereof in relation to the cantilevered latch portion) a contact surface 280 (e.g., beveled/angled surface) that is repositionable to disengage the latch portion.

Thus, in an example embodiment, a cutter apparatus includes a housing (e.g., shaped to be hand-held) with a blade carrier configured for holding a blade, the housing including (e.g., left side and right side) handle portions which are (coupled together at a base portion thereof and) repositionable in relation to each other to and from a closed configuration (e.g., at which complementary surfaces of the handle portions are interfitted and the housing portions secured together), the housing including or being configured with a release/engagement mechanism (interface) for disengaging/securing together the handle portions, the release/engagement mechanism, when the handle portions are in the closed configuration, being accessible via an opening in a side portion of the housing. In example embodiments and implementations, the release/engagement mechanism includes a release member that is repositionable within the opening. In example embodiments and implementations, the release/engagement mechanism is part of, coupled with, or connected to an opposite side of the housing in relation to the opening. In example embodiments and implementations, the release/engagement mechanism includes a latch device (e.g., including a cantilevered latch portion) with an inside-facing surface that engages an outward-facing surface (e.g., within the opening) to secure the handle portions together. In example embodiments and implementations, the release/engagement mechanism includes a release member, a cantilevered latch portion configured to secure the handle portions together, and a contact surface that is repositionable to be brought to bear against a portion of the cutter apparatus in order to disengage the cantilevered latch portion from said side portion of the housing. In example embodiments and implementations, the release/engagement mechanism includes an engagement portion that latches opposite (left and right side) opposing interfitted portions of cutter apparatus together when said portions are brought together to the closed configuration. The handle portions can include, for example, top and bottom side surfaces for urging the handle portions apart.

Example embodiments of cutters (or cutter apparatuses) include structures for guiding housing portions (of the cutter apparatus) when the housing portions are being brought together to a closed configuration, the structures including guide surface(s) or portion(s) of a blade holder and/or actuator coupled to one of said housing portions and complementary surface(s) or portion(s) of another of said housing portions.

Referring to FIGS. 9, 16A, 16B, 17 and 18, in an example embodiment, the housing 102 is configured with surfaces/structures for (aligning and/or) guiding the housing portions 104, 106 when they are being brought together to a closed configuration (e.g., at which the housing portions are releasably secured/engaged to each other), the surfaces/structures including a (an angled laterally extending top) guide surface or portion of the blade holder and/or actuator (e.g., the bottom side of the laterally extending portion 154*a* and complementary surface(s) or portion(s) of (or operatively associated with) another of the housing portions, namely, the proximal opening portion 136*a* of the safety window (of the cut guide/guard 130*a*). As the engagement portion 152*a* advances into the opening portion 116*a* (of handle portion 104) (e.g., the top side of the laterally extending portion 154*a*), other complementary surface(s) or portion(s) is/are involved, namely, the edge portion 114*a* (FIG. 17) at the top side of the opening 110*a* of handle portion 104.

Referring to FIGS. 14A, 14B, 19 and 20, the structures can also include guide surface(s) or portion(s) of the housing portions (e.g., angled guide surface 166 of the latch (device) 270) which, when the handle portions are brought together toward the closed configuration, is brought into contact with complementary surface(s) or portion(s) (e.g., the inward-facing angled surface 168 adjacent to the opening 160) of (or operatively associated with) another of the housing portions.

Figure 16A:
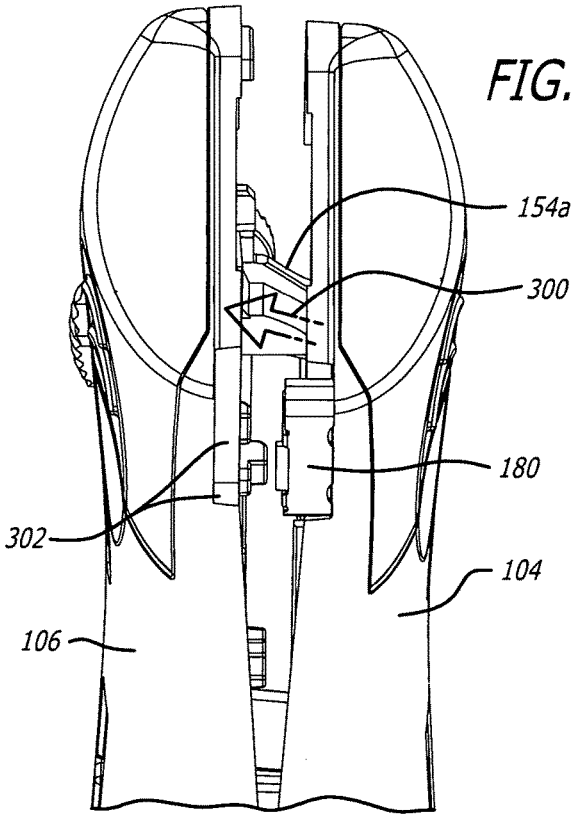
FIG. 16A is a partial perspective view showing the housing (or handle) portions of the cutter apparatus of FIG. 1 being repositioned toward each other, the left side portion being guided toward the right side portion by an angled laterally extending guide surface or portion of the blade holder and/or actuator, the wear plate (or wear resistant structure or wear protection portion) of FIGS. 7A-7G being secured to the left side portion.
Figure 16B:
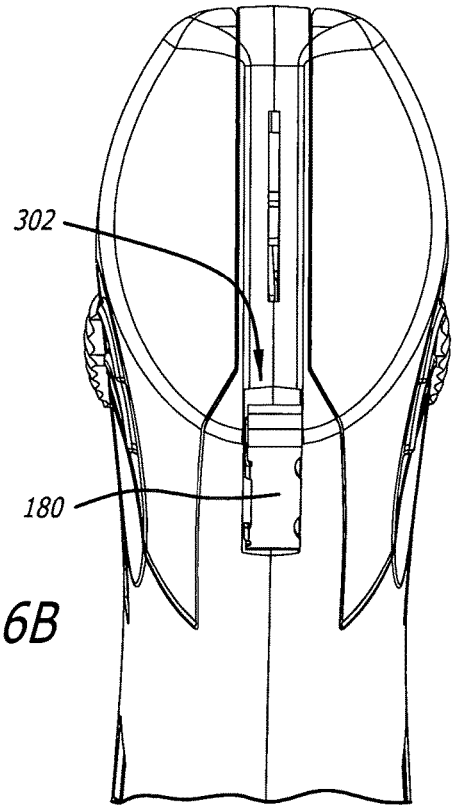
FIG. 16B is a partial perspective view showing the housing (or handle) portions, depicted in FIG. 16A, having been brought together to a closed configuration at which the housing portions are releasably secured/engaged to each other and at which the wear plate (or wear resistant structure or wear protection portion) secured to the left side portion is seated (repositioned into) against a complementary recess in the right side portion.

Thus, in an example embodiment, a cutter apparatus includes a housing (e.g., shaped to be hand-held) with housing portions (e.g., left side and right side handle portions) which are coupled together (e.g., at a base portion thereof) and repositionable in relation to each other, and a blade holder and/or actuator coupled to (and repositionable in relation to) one of said housing portions, the housing being configured with structures for (aligning and/or) guiding the housing portions when the housing portions are being brought together to a closed configuration (e.g., at which the housing portions are releasably secured/engaged to each other), the structures including guide surface(s) or portion(s) of the blade holder and/or actuator and complementary surface(s) or portion(s) of another of said housing portions. In example embodiments and implementations, the cutter apparatus further includes a cut guide (or guard) configured to only allow the housing portions to be brought together to the closed configuration when the cut guide and the blade holder and/or actuator are in fully retracted positions, respectively. In example embodiments and implementations, the cutter apparatus further includes a cut guide (or guard) including a safety aperture (such as aperture 136*a* or 136*b*, for example) that only coaligns or registers with an opening (such as opening portion 116*a* or 116*b*, for example) in said cutter apparatus to allow the housing portions to be brought together to the closed configuration when the cut guide (or guard) is in a fully retracted position. Referring to FIGS. 16A and 16B, in example embodiments and implementations, the cutter apparatus further includes a wear plate (such as the wear plate 180, for example) secured to a portion of the housing (such as the complementary portion 185, for example), the guide surface(s) or portion(s) of the blade holder and/or actuator being configured to reposition the wear plate, responsive to the housing portions being pushed (for example, as denoted by arrow 300 in FIG. 16A) together, into a complementary recess (such as the complementary recess 302, for example) in another portion of the housing. In example embodiments and implementations, the guide surfaces/structures are configured to reposition the wear plate laterally and (slightly) upward toward and in relation to said complementary recess. In example embodiments and implementations, the surfaces/structures (further) include rails at a base portion of cutter (and complementary surfaces in opposite inside portion of cutter housing).

Accordingly, in example embodiments and implementations, structures on a blade holder and/or actuator that is coupled to a housing portion of a cutter or cutter apparatus include guide surface(s) or portion(s)—provided on an engagement portion/element of the blade holder and/or actuator—for guiding housing portions (of the cutter or cutter apparatus) when the housing portions are being brought together to a closed configuration, the structures additionally including complementary surface(s) or portion(s) of another of said housing portions.

Example embodiments of cutters (or cutter apparatuses) include a tape splitter having (one or more) portions including chamfer surfaces. The portions are, for example, top and bottom facing portions. In example embodiments and implementations, the (one or more) portions each include chamfer surface(s) adjoined at a tape splitter point. In example embodiments and implementations, the (one or more) portions each have a curved radius.

Referring to FIGS. 22A and 22B, in an example embodiment, the cutter apparatus 100 includes a tape splitter 240 formed or otherwise provided on the handle portion (e.g., at a base portion 112 thereof), the tape splitter having top 242 and bottom facing edge portions 244 including chamfer surfaces 243 and 245, respectively, adjoined at (e.g., contiguously meeting at) a tape splitter point 246.

Thus, in an example embodiment, a cutter apparatus includes a housing with a handle portion, the housing being configured to allow a user of the cutter apparatus to deploy a blade, and a tape splitter formed or otherwise provided on the handle portion, the tape splitter having portions (e.g., top and bottom facing edge portions) including chamfer surfaces (adjoined at a tape splitter point). In example embodiments and implementations, the portions (including chamfer surfaces) each have a curved radius (e.g., concave as shown).

Example embodiments of cutters (or cutter apparatuses) include one or more cut guide(s)/guard(s) having a (guide) surface (or portion) that includes (e.g., defines) a pattern of openings that reduce friction when cutting (e.g., during a cutting operation).

Referring to FIGS. 4E, 5C, 27, 29, 30 and 31, in an example embodiment, the cut guides (or guards) 130*a*, 130*b* each include or are provided with a beveled/angled/inner (guide) surface (or portion) 140*a*, 140*b*, respectively, that includes (e.g., a geometric angular pattern of) openings/holes that reduce friction (between the surface and an object contacting said surface) when cutting. Referring to FIG. 27, the cut guides (or guards) 130*a*, 130*b* also respectively include opposing angled surfaces 142*a*, 142*b* for angle cutting, and the housing includes substantially flat surfaces 141*a*, 141*b* for straight cutting.

Thus, in an example embodiment, a cutter apparatus includes a housing shaped to be hand-held, a blade holder configured to support a blade, and one or more cut guides each having a blade-facing surface or portion including or defining a pattern of openings that reduce friction when cutting. In example embodiments and implementations, the cut guide(s) include at least one cut guide that is extendable in relation to the housing to deploy the blade. In example embodiments and implementations, the blade-facing surface or portion is exposed or accessible (only) when a cut guide bearing said surface or portion is in an extended position in relation to the housing (e.g., a beveled/angled inner portion thereof facing a blade when said blade is deployed). In example embodiments and implementations, for at least one of said cut guide(s), said pattern of openings is defined by a generally orthogonal arrangement of contact surfaces (e.g., as between surfaces 140*a* and 142*b*, or as between surfaces 140*b* and 142*a*). In example embodiments and implementations, for at least one of the cut guide(s)/guard(s), the pattern of openings is provided in a stair-step or staggered arrangement (of the openings).

Referring to FIGS. 1, 2, 24 and 26, in an example embodiment, the handle portions include or are provided with window structures 310*a*, 310*b* configured to provide a visual indication to the user of whether a cut guide/guard is fully extended.

Although the present invention(s) has(have) been described in terms of the example embodiments above, numerous modifications and/or additions to the above-described embodiments would be readily apparent to one skilled in the art. It is intended that the scope of the present invention(s) extend to all such modifications and/or additions.

What is claimed is:

1. A cutter apparatus comprising:

a housing shaped to be hand-held, the housing including first and second handle portions shaped to interfit together;

a blade carrier/actuator repositionable in relation to the housing and configured to support a blade thereon, the blade carrier/actuator being operable for extending the blade from the housing to an extended position;

first and second cut guides coupled to and repositionable in relation to distal portions of the handle portions, respectively, and independently operable for extending the blade from the housing and simultaneously overlapping the blade in the extended position; and a lock/unlock mechanism including a latch surface for securing the handle portions together, the blade carrier/actuator and the cut guides being repositionable to respective locations at which an aperture of the first cut guide coaligns or registers with an opening in the first handle portion in an unlock configuration that allows a user of the cutter apparatus, after disengaging the latch surface from a housing/handle surface, to reposition the first handle portion away from the second handle portion, wherein the blade carrier/actuator includes a laterally extending portion configured to allow, only in the unlock configuration, coaligned structures of the first cut guide and the first handle portion to reposition along the laterally extending portion.

2. The cutter apparatus of claim 1, wherein the blade carrier/actuator and the cut guides are in fully retracted positions in the unlock configuration.

3. The cutter apparatus of claim 1, wherein the cut guides are configured to drive the blade carrier/actuator to extend the blade.

4. The cutter apparatus of claim 1, wherein the blade carrier/actuator is coupled to the second handle portion and remains coupled to the second handle portion after the first and second handle portions are repositioned away from each other.

5. The cutter apparatus of claim 1, wherein the first cut guide is slidably supported within the first handle portion.

6. The cutter apparatus of claim 1, wherein the second cut guide is supported by and repositionable in relation to the second handle portion, the blade carrier/actuator and the second cut guide being secured to the second handle portion independent of whether the cutter apparatus is in the unlock configuration or whether the first and second handle portions are interfitted together in a closed configuration.

7. The cutter apparatus of claim 6, wherein the second cut guide is slidably supported within the second handle portion by an inwardly extending structure coupled to the second handle portion, said inwardly extending structure including orthogonal support members.

8. The cutter apparatus of claim 1, wherein the second handle portion includes or is coupled to a guide member that slidably secures the blade carrier/actuator to the second handle portion.

9. The cutter apparatus of claim 1, wherein the blade carrier/actuator includes a plurality of engagement portions including dual engagement portions which extend from openings in the first and second handle portions, respectively.

10. The cutter apparatus of claim 1, wherein the blade carrier/actuator is repositionable in relation to the cut guides to deploy the blade.

11. The cutter apparatus of claim 1, wherein the blade carrier/actuator and the cut guides are configured such that movement of the blade carrier/actuator to a fully retracted blade carrier/actuator position necessarily also retracts any of the first cut guide and the second cut guide not already in a fully retracted first cut guide position and a fully retracted second cut guide position, respectively; and wherein the blade carrier/actuator is repositionable in relation to the housing to a blade deployment position, the blade carrier/actuator and the cut guides being configured such that, when the blade carrier/actuator is in the blade deployment position, the cut guides are repositionable between retracted and extended cut guide positions in relation to the housing.

12. The cutter apparatus of claim 11, wherein the blade carrier/actuator and the cut guides are configured such that when the first and second handle portions are interfitted together in a closed configuration and one or more of the cut guides is repositioned to said extended cut guide position, a user of the cutter apparatus can maintain said blade deployment position by holding either the blade carrier/actuator or any of the cut guides in the extended position of the blade carrier/actuator and the extended position of the cut guide, respectively.

* * * * *